US008714674B2

(12) United States Patent
Katerberg et al.

(10) Patent No.: US 8,714,674 B2
(45) Date of Patent: May 6, 2014

(54) CONTROL ELEMENT FOR PRINTED DROP DENSITY RECONFIGURATION

(75) Inventors: James A. Katerberg, Kettering, OH (US); Ronald J. Duke, Centerville, OH (US); Gilbert A. Hawkins, Mendon, NY (US)

(73) Assignee: Eastman Kodak Company, Rochester, NY (US)

( * ) Notice: Subject to any disclaimer, the term of this patent is extended or adjusted under 35 U.S.C. 154(b) by 175 days.

(21) Appl. No.: 13/358,548

(22) Filed: Jan. 26, 2012

(65) Prior Publication Data

US 2013/0194330 A1 Aug. 1, 2013

(51) Int. Cl.
*B41J 29/38* (2006.01)

(52) U.S. Cl.
USPC ..... 347/10; 347/54; 347/9; 347/62

(58) Field of Classification Search
USPC ..... 347/5, 9, 10, 14, 20, 54, 56–59, 61–62, 347/73–78
See application file for complete search history.

(56) References Cited

U.S. PATENT DOCUMENTS

| | | | |
|---|---|---|---|
| 4,123,760 | A | 10/1978 | Hou |
| 4,274,100 | A | 6/1981 | Pond |
| 4,636,808 | A | 1/1987 | Herron |
| 5,841,452 | A | 11/1998 | Silverbrook |
| 6,068,362 | A | 5/2000 | Dunand et al. |
| 6,079,821 | A | 6/2000 | Chwalek et al. |
| 6,213,595 | B1 | 4/2001 | Anagnostopoulos et al. |
| 6,217,163 | B1 | 4/2001 | Anagnostopoulos et al. |
| 6,457,807 | B1 | 10/2002 | Hawkins et al. |
| 6,460,961 | B2 | 10/2002 | Lee et al. |
| 6,491,362 | B1 | 12/2002 | Jeanmaire |
| 6,505,921 | B2 | 1/2003 | Chwalek et al. |
| 6,508,532 | B1 | 1/2003 | Hawkins et al. |
| 6,517,197 | B2 | 2/2003 | Hawkins et al. |
| 6,536,873 | B1 * | 3/2003 | Lee et al. ..... 347/54 |
| 6,554,410 | B2 | 4/2003 | Jeanmaire et al. |
| 6,575,566 | B1 | 6/2003 | Jeanmaire et al. |
| 6,588,888 | B2 | 7/2003 | Jeanmaire et al. |
| 6,793,328 | B2 | 9/2004 | Jeanmaire |
| 6,827,429 | B2 | 12/2004 | Jeanmaire et al. |
| 6,851,796 | B2 | 2/2005 | Jeanmaire et al. |
| 7,364,277 | B2 | 4/2008 | Chwalek et al. |
| 7,438,396 | B2 | 10/2008 | Weksler et al. |
| 7,524,042 | B2 | 4/2009 | Weksler et al. |

(Continued)

FOREIGN PATENT DOCUMENTS

| | | |
|---|---|---|
| EP | 0 911 165 | 4/1999 |
| EP | 0 729 846 | 1/2000 |
| WO | 2005/100030 | 10/2005 |

*Primary Examiner* — Juanita D Jackson

(74) *Attorney, Agent, or Firm* — William R. Zimmerli; Amit Singhal

(57) ABSTRACT

A continuous printing system includes a printhead and a controller. The printhead includes a nozzle and a jet control element including a continuous heater element positioned to surround the nozzle. A plurality of three or more electrical contacts is in electrical communication with the continuous heater element and define a plurality of three or more continuous heater element portions that are actuatable with sufficient independence so as to control jet steering. The number of the continuous heater element portions equals the number of electrical contacts. A controller is configured to apply a waveform to at least one of the plurality of three or more electrical contacts to affect at least one of the plurality of independently actuatable continuous heater element portions.

6 Claims, 23 Drawing Sheets

(56) References Cited

U.S. PATENT DOCUMENTS

| | | | |
|---|---|---|---|
| 7,735,981 | B2 | 6/2010 | Vaeth et al. |
| 7,748,829 | B2 | 7/2010 | Hawkins et al. |
| 7,914,109 | B2 | 3/2011 | Xie et al. |
| 7,914,121 | B2 | 3/2011 | Xie et al. |
| 7,946,692 | B2 | 5/2011 | Hawkins et al. |
| 8,007,082 | B2 | 8/2011 | Hawkins et al. |
| 8,011,764 | B2 | 9/2011 | Hawkins et al. |
| 8,016,395 | B2 | 9/2011 | Hawkins et al. |
| 8,033,646 | B2 | 10/2011 | Xie et al. |
| 8,033,647 | B2 | 10/2011 | Xie et al. |
| 2004/0207692 | A1 | 10/2004 | Yamamoto |
| 2007/0253040 | A1 | 11/2007 | Lee et al. |
| 2010/0258205 | A1 | 10/2010 | Hawkins et al. |
| 2011/0242228 | A1 | 10/2011 | Link |

* cited by examiner

CONTROL ELEMENT FOR PRINTED DROP DENSITY RECONFIGURATION

CROSS REFERENCE TO RELATED APPLICATIONS

Reference is made to commonly-assigned, U.S. patent application Ser. No. 13/358,545, entitled "CONTROL ELEMENT FOR HUNTED DROP DENSITY RECONFIGURATION", Ser. No. 13/358,558, entitled CONTROL ELEMENT FOR PRINTED DROP DENSITY RECONFIGURATION", all filed concurrently herewith.

FIELD OF THE INVENTION

This invention relates generally to the field of digitally controlled printing systems or devices, and in particular to continuous printing systems or devices in which individual liquid streams jetted from an associated array of individual nozzles break into drops that are permitted to contact a receiver.

BACKGROUND OF THE INVENTION

Ink jet printing has become recognized as a prominent contender in the digitally controlled, electronic printing arena because, e.g., of its non-impact, low-noise characteristics, its use of plain paper, and its avoidance of toner transfer and fixing. Ink jet printing mechanisms can be categorized by technology as either drop on demand ink jet (DOD) or continuous ink jet (CIJ).

The first technology, "drop-on-demand" (DOD) ink jet printing, provides ink drops that impact upon a recording surface using a pressurization actuator, for example, a thermal, piezoelectric, or electrostatic actuator. One commonly practiced drop-on-demand technology uses thermal actuation to eject ink drops from a nozzle. A heater, located at or near the nozzle, heats the ink sufficiently to boil, forming a vapor bubble that creates enough internal pressure to eject an ink drop. This form of inkjet is commonly termed "thermal ink jet (TIJ)."

The second technology commonly referred to as "continuous" ink jet (CIJ) printing, uses a pressurized ink source to produce a continuous liquid jet stream of ink by forcing ink, under pressure, through a nozzle. The stream of ink is perturbed using a drop forming mechanism such that the liquid jet breaks up into drops of ink in a predictable manner. One continuous ink jet printing technology uses thermal stimulation of the liquid jet with a heater to form drops that eventually become print drops and non-print drops. Printing occurs by selectively deflecting one of the print drops and the non-print drops and catching the non-print drops. Various approaches for selectively deflecting drops have been developed including electrostatic deflection, air deflection, thermal deflection, mechanical deflection, deflection by alteration of the fluid velocity field, both within the body of ink and externally coupled to the body of ink, and deflection based on changes in the contact free energy of the ink contacting a solid surface (often referred to as surface deflection, as is known in the art of continuous inkjet printing.

In both drop on demand and continuous ink jet technologies print drops land at various positions on the receiver, the potential landing locations of the printed drops can be described by a hypothetical 'pixel grid' on the receiver. The representation of the potential landing locations of printed drops as a hypothetical pixel grid is used extensively in technical analyses and in product specifications including printer resolution. For example, as is well known in the art of ink jet printing, in binary printing, each pixel grid on the receiver receives either one or no ink drop. Also by way of example, many products are known in the art of commercial printing having pixel grids of from 600×600 pixels per inch to 2400×2400 pixels per inch. The concept of a pixel grid allows classification of system architectures and is particularly useful in analyzing the effects of drop steering on printer performance. The hypothetical pixel grid on the receiver (or paper or substrate) has a spatial density, typically measured in units of inverse inches (per inch), in both a direction perpendicular and parallel to the direction of the receiver (paper) path relative to the printhead mechanism. These spatial densities are equivalent to the reciprocals of the spatial dimensions in the two directions. Typically, the edge locations for the spatial grid in the direction perpendicular to the receiver path are the same, whereas the edge locations of the spatial grid in the direction of the receiver path can vary up to the spatial dimension in that direction. For example, when even and odd printhead nozzles fire exactly out of phase, the edge locations of the spatial grid in the direction of the receiver path alternate by half the dimension of the spatial grid in that direction, as can be appreciated by one skilled in inkjet systems engineering.

The dimensions of the pixel grid and the way in which drops can fill the pixels of the pixel grid depend on the type of printing system architecture, which in turn is based on the type of drop ejection technology. Continuous drop ejection technologies typically include one or more jetting modules having a plurality of nozzle plates each with nozzles formed in a regular linear array and oriented approximately perpendicular to a receiver path. The nozzles have a well-defined spacing along the nozzle array (typically perpendicular to the receiver path) and hence have a well defined 'native' spatial nozzle density measured as the number of nozzles per inch (npi) along the direction of the array. For example, products are known in the art of commercial printing having 'native' spatial nozzle densities in the range of 200 to 2400 npi. Typically, each nozzle can print drops onto the receiver.

The pixel grid characterizing the location of the drops printed on the receiver is typically a regular array (that is, evenly spaced in both directions) characterized by a well defined number of pixels per inch perpendicular to the receiver path (usually called the slow scan direction or the direction aligned along the nozzle array) and a well defined number of pixels per inch in the direction of the receiver path (usually called the fast scan direction or the direction aligned perpendicular to the nozzle array). As is well known, the simplest pixel grid is an array of squares with edges aligned (or collinear) in both the direction of the travel path of the receiver and in the direction perpendicular to the travel path of the receiver. However other printing architectures are well known, having, for example, pixel grid arrays of rectangles. This occurs when the receiver speed and drop print frequency are such that the pixel grid in the direction of the receiver travel path is larger than or smaller than (but not equal to) the pixel grid in the direction perpendicular to the receiver path. If the nozzle array is perpendicular to the receiver path and all printed drops fire simultaneously along the nozzle array, than the pixel grid is an array of rectangles with edges aligned in both the direction of the travel path of the receiver and in the direction perpendicular to the travel path of the receiver. If the printed drops fire at delayed times with respect to one another along the nozzle array, than the pixel grid is an array of trapezoids, as is well known in the art of ink jet systems architectures. For binary printing, the vertices of the hypothetical pixel grid array have the same spatial pattern as the landing sites of drops when all drops are printed. Unless stated otherwise, the preferred landing location of drops for binary printing is here taken to be in the center of the pixels of the pixel grid. Printed drops land in the areas defined by the pixel grid (referred to as pixels) in different ways depending on print system architecture. For example, as is well known in the art of ink jet printing, in binary printing, each pixel grid on the receiver receives either one ink drop or no ink drops; where as in contone printing, each pixel receives either a varying number of drops, including zero, or a drop of a variable size.

The spatial density of the pixel grid in the slow and fast scan directions is frequently identical and equal to the native spatial nozzle density For example pixel grids of 600×600 pixels per inch (often called dots per inch, particularly when referring to binary printers) printers using 600 npi nozzle arrays are know in the art. Here, the first number indicates the spatial density perpendicular to the receiver path and the second indicates the spatial density parallel to the receiver path. However, in some alternate printer system architectures, the spatial density in the fast scan direction is configured to differ very significantly from that in that slow scan direction. For example, printing with a 600 npi nozzle array onto a 600×900 pixels per inch (ppi) grid achieves a different result than from printing with a 600 npi nozzle array onto a 600×600 pixels per inch grid. The 600×900 pixels per inch grid architecture is frequently achieved by moving the receiver 50% slower than in the case of printing on a 600×600 pixels per inch grid, resulting in 50% lower print system productivity but with superior image quality. A 600×900 pixels per inch pixel grid can also be achieved by increasing the frequency of drop formation, but this requires a higher frequency performance of the jetting module and may also require adjusting the drop size so as to avoid excess drop overlap. Such system architectures are useful in product lines that serve different applications, each having different speed and quality requirements.

As another example, in an alternate printer system architecture, the spatial density in the slow scan direction significantly exceeds the native npi of the nozzle array. Prior art teaches the use of a nozzle to address multiple pixels, by steering the drops at least in a direction partially aligned with the nozzle row (perpendicular to the paper path), for the purpose of reducing the number of nozzles required, a nearby nozzle being steered to "cover" drop printing when needed into adjacent pixels. In these cases, nozzles are associated with more than one pixel. Such system architectures can be achieved by steering drops from each nozzle so that each nozzle can print sequentially into multiple, closely adjacent (in the direction perpendicular to the receiver path) pixels. For example, printing with a 200 npi nozzle array onto a pixel grid of 600 pixels per inch in the direction perpendicular to the receiver path can be achieved by having each nozzle print sequentially into three pixels. This results in an increase of image quality due to the higher resolution perpendicular to the receiver path, albeit at a reduction of three in speed, since the receiver must move more slowly to allow time for each nozzle to print in multiple locations.

As another example, in alternate printer system architecture, the spatial density in the slow scan direction is increased in comparison with the native nozzle density by angling the printhead so that the row of nozzles is no longer perpendicular to the receiver path. For example, printing with a 600 npi nozzle array onto a pixel grid of 850 pixels per inch in the direction perpendicular to the receiver path can be achieved by rotating the print module by approximately 45 degrees. Of course, this requires a mechanically precise rotation means, and the resulting module occupies more space in the direction of the receiver path, which adds complexity and cost.

As another example, in an alternate printer system architecture, the spatial density in the fast scan direction is decreased in comparison to that in the slow scan direction. For example, printing with a 600 npi nozzle array onto a pixel grid of 600×300 pixels per inch (300 pixels per inch in the direction along the receiver path) in comparison to a pixel grid of 600×600 pixels per inch can be achieved by doubling the speed of the receiver while keeping the drop formation rate the same, hence increasing productivity.

Typically, most methods of producing inkjet printer systems result in printers having receiver pixel grids fixed at the time of manufacture, for example a pixel grid of size 1200 by 1200 pixels per inch in directions perpendicular and parallel with the receiver path respectively is common, as is a grid size of 600 by 600 pixels per inch. Grid dimensions are often the same, machine to machine. An inkjet printer could be manufactured with an unusual pixel grid density, for example 673 by 1333 pixels per inch, by building nozzles plates with specially spaced nozzles and by running the printer at non-conventional ratios of print frequency to receiver speed. Although, as discussed below, there would be performance advantages to such unusual pixel grid densities, such low volume products are expensive and have not found widespread use.

In some printer system architectures, including binary and contone, the position of drops within receiver pixels can be selectively controlled to improve image quality, for example to improve the accuracy of certain printed characters, such as serifs on individual letters. In this architecture, the position of drops within receiver pixels must be changed very frequently (up to the pixel print rate) since the image content can change from pixel to pixel. Since data flow rates are limited in practice by cost and technology constraints, the number of positions of drops within receiver pixels to improve printed characters is limited.

The receiver pixel dimension perpendicular to the receiver path is generally taught to be constant over the entire length of the printhead for reasons of consistency of image quality and to simplify image data ripping and rasterization. Thus a printing system having a pixel density in the direction perpendicular to the receiver path of 600 pixels per inch along a portion of the printhead generally maintains this density over the entire printhead length. Also, the receiver pixel dimension perpendicular to the receiver path is generally taught to be constant over time during printing. A conventional printer having a particular pixel density in the direction perpendicular to the receiver path is not reconfigurable during printing to a printer having a different pixel density even though there are situations where such pixel density reconfigurations during printing operations would be of value.

Watermarking, for example, is commonly used in secure document printing with one implementation including the encoding of machine readable information in the patterns of printed dots. Typically, watermarking is achieved by subtle variations of the positions of printed drops, although reading this information requires sophisticated image scanners. As such, there remain barriers, including cost and complexity, to reliably printing high quality secure documents and there is a well-recognized need for improvement in this area.

In technologies for watermarking inkjet prints, an important objective is to allow rapid and low cost machine identification or tagging of document origin. Another objective is to prevent copying unauthorized documents inexpensively. For example, it is not difficult to copy documents convincingly using inkjet printing, since both the original print and the copy often have identical or commensurate pixel grids. For example, contone copying machines having high grid densities, for example 1200 (or 2400) pixels per inch, can be operated as machines having grid densities of 600 pixels per inch, simply by omitting print drops in every other (or every fourth) pixel and printing larger drops in the pixels used.

The pixel spacing in the direction parallel to the receiver path is relatively easy to alter, by adjusting the receiver speed. However, this can be done both for the copy machine as well as for the original printer and so does not provide a means of securing documents against copying. Other more complex methods of image water marking have been developed to help prevent unauthorized copying, but such software techniques can be mimicked if the copy printer and original document printer are physically similar. On the other hand, the pixel spacing in the direction perpendicular to the receiver path has not proved easy to alter, although the ability to alter this parameter on the original document printer would present great difficulties for printers attempting to make convincing copies. As noted, an inkjet printer could be manufactured with an unusual pixel grid density, for example 673 by 1333 pixels per inch which would present difficulties of reproduction for machines capable of printing only fixed, standard pixel grids, for example 1200 by 1200 pixels per inch. However, such "one-off" production examples are not cost effective.

A second prior art method to accomplish an altered pixel spacing in the direction perpendicular to the receiver path is available to printers having an array of nozzles each of which can addresses multiple closely adjacent pixels. For example, if each nozzle can address three pixels, then each nozzle could be programmed to address 2 pixels or possibly 4 pixels depending upon the maximum amount of steering available. This type of change in the pixel density in the direction perpendicular to the receiver path very substantially alters the amount of drop steering required and the number to times the drops are steered. The altered pixel density would differ by a large amount from the original density and the result of changing the pixel density would easily be visible to the human eye. In the above example, such alterations would result in a new pixel grid whose spatial density in the direction perpendicular to the receiver was altered by factors of 1.33 and 0.67. These changes would substantially alter the image quality and speed of the printer hence it is not surprising that such alteration is not found in practice. Additionally, an array of nozzles, each of which can address multiple closely adjacent pixels, has a correspondence between nozzles and pixels that is not one to one. This introduces additional cost and system complexity and reduces speed. Alterations resulting in a new pixel grid whose spatial density in the direction perpendicular to the receiver has been increased by a small amount, for example 1%, are not contemplated in the prior art of nozzles which do not have a one to one correspondence between nozzles and receiver pixel.

The representation of the potential landing locations of printed drops as a hypothetical receiver pixel grid is useful in analyzing drop placement errors on the receiver. For example, in binary printing, the printed drops typically are intended to land in the pixel centers, or, if the landing locations are subject to random fluctuations, the mean positions of drops are typically intended to be in the pixel centers. Deviations from the desired position may be measured and corrected in some print system architectures. This is an important image quality issue, since repetitive errors in the position of a single misdirected drop are high visible to the eye. For example, if one nozzle is persistently misdirected and produces drops landing at the bottom right of its intended pixel, image quality is compromised. Corrective steering can be applied to move such drops towards the pixel center and requires only a one-time adjustment. However, in this example, if the nozzle fails entirely, for example, by no longer emitting liquid, then it is generally not possible to correct the operation of that nozzle. This is a common occurrence among drop on demand printers of the thermal inkjet type, and is typically solved by redundancy, i.e. by employing an additional set of nozzles to place drops in the positions the failed nozzle would have placed them, albeit at a different moment in time, or by multiple scans. This procedure is disadvantageous because it slows printer operation in the case the printhead makes many passes over the same receiver area or requires a backup set of nozzles that add cost and complexity. Accordingly, there is a need for an improved solution for failed nozzles, especially for single pass printers in which the document passes only a single time under the printhead.

The concept of potential landing locations of printed drops on a grid can also be extended to analyze drop placement on the catcher for the case the printer is of the continuous type. For example, in binary printing, the non-printed drops typically are intended to land in a particular position on the catcher; when no drops are printed and all drops land on the catcher, the landing positions should ideally form a straight 'catch line', with the positions of the drops approximately evenly spaced in the direction along the nozzle array. Deviations from the desired positions are well known to decrease system reliability due to exceptionally non-uniform accumulation of fluid on the catcher, which is particularly severe when the fluid is viscous, as is often the case for inkjet printing inks. Typically, deviations are not controlled; rather printheads are selected to have the best catch performance, for example, those selected for production might have a small root mean square (rms) deviation of the landing locations from the ideal catch line. This approach tends to be costly. As such, there is a need to improve the consistency of landing positions of unprinted drops on a catcher during printing such that these landing positions are as close as possible to desired landing positions during printing.

The representation of the potential landing locations of printed drops as a pixel grid is also useful in compensating for deformations of the receiver, for example deformations due to wet load as subsequent colors are printed. Generally, as is well known in the art of inkjet printing, a high liquid content causes the receiver to stretch, thereby very slightly altering the effective pixel spacing, for example by less than one percent, when an image is printed on a stretched receiver that subsequently dries and returns to its original dimension. If the stretching is uniform, then in the direction along the paper path, the final printed receiver grid can be controlled in principal by altering the receiver speed or the print frequency, so that the dried receiver displays the intended pixel grid in the direction of the receiver path, as is well known. However, this technique cannot be used to keep the intended pixel grid constant in the direction perpendicular to the receiver path because timing cannot alter the pixel grid in that direction and the dried print will exhibit printed drops more closely spaced than desired, as is also well known. Current printers can alter the image data in response to anticipated changes in receiver dimensions, and while this may improve image quality it is not a totally satisfactory solution, since the spacing of drops in the direction perpendicular to the paper path is not restored to the desired values. A need exists, therefore, to guard against image artifacts due to stretching of the receiver.

SUMMARY OF THE INVENTION

According to one aspect of the invention, a method and an apparatus are provided to alter placement of drops in a continuous inkjet printer system. Advantageously, the method and apparatus of the present invention cost effectively provide at least one of improved reliability, image quality, or document security. Document security (as well as secure document printing) as described herein refers to the ability to subtly mark documents in ways not apparent to human readers, so that the source of the documents can be identified by machine readers for identification or authentication purposes or so that non-authorized copying can be prevented or identified if it occurs.

According to another aspect of the present invention, a method and an apparatus is provided for altering, during printing, the spatial density of the receiver pixels in the direction perpendicular to the paper path, over the entire printhead width, by amounts which differ only very slightly from the original spatial density of the receiver pixels perpendicular to the paper path.

In one example embodiment of the present invention, a continuous inkjet printer system includes a regular (evenly spaced) receiver pixel grid of a first type and having a one to one correspondence between the native nozzle density of nozzles located on a nozzle plate. The spatial density of receiver pixels in the direction perpendicular to the receiver path through activation of a trigger signal, during printing, causes deactivation of one or more selected nozzles in the print module and further sends to memory elements on the nozzle plates finely tailored drop steering data calculated to reconfigure the pixel grid to a regular receiver pixel grid of a second type, the first and second pixel grids differing in spatial density by less than one per inch. Finely tailored steering here refers to drop steering that can be controlled in a large number of very finely spaced stepwise increments over a small range of magnitude in any direction (for example, in a direction perpendicular, in a direction parallel, or in a combination of directions perpendicular and parallel to the receiver path). The regular receiver pixel grid of the second type no longer exhibits a one to one correspondence between the native nozzle density of the nozzle plates and the spatial density of receiver pixels in the direction perpendicular to the receiver path. Altering, during printing, the spatial density of the receiver pixels in the direction perpendicular to the paper path, for example, helps to maximize system productivity, image quality, and reliability. In one example embodiment of the present invention, thermal steering devices and techniques are provided for altering, during printing, the spatial density of the receiver pixels in the direction perpendicular (or parallel) to the paper path by thermal steering.

According to another aspect of the invention, a printing system is provided that includes a well defined spatial density of the positions of the printed drops on the receiver perpendicular to the receiver path can be reconfigured during printing to print with an altered spatial density of the positions of printed drops perpendicular to the receiver path. Reconfiguration of the pixel spatial density in the direction perpendicular to the receiver path which only slightly alter the pixel density have not contemplated by prior art.

According to another aspect of the invention, the printing system includes a device(s) for altering, during printing, the spatial density of the receiver pixels in the direction perpendicular to the paper path which minimize system data transmission requirements and relax the requirements imposed on the time response for drop steering.

According to another aspect of the invention, the printing system includes a device(s) for altering, during printing, the spatial density of the receiver pixels in the direction perpendicular to the paper path which can be modulated over macroscopic portions of the receiver in the direction perpendicular to the paper path.

According to another aspect of the invention, the printing system includes a device(s) for altering, during printing, the spatial density of the receiver pixels in the direction perpendicular to the paper path and manipulating data to reformat the original image content consistent with the altered spatial density.

According to another aspect of the invention, the printing system includes a device(s) for altering, during printing, the spatial density of the receiver pixels in the direction perpendicular to the paper path and additionally providing alteration of the steering of drops in the direction along the paper path.

According to another aspect of the invention, the printing system includes a device(s) for altering, during printing, the spatial density of the receiver pixels in the direction perpendicular to the paper path and additionally providing alteration of the steering of drops in the direction along the paper path to control the landing positions of non-printed drops on a catcher.

According to another aspect of the invention, the printing system includes a memory device(s) is provided on a nozzle plate for repetitively controlling the amount of steering of drops and of drop formation, the components of the memory device(s) being associated on a one to one basis with the nozzles located on the nozzle plate. Data processing devices are also provided to reformat the original image data in real time to match the newly configure spatial density of receiver pixels in the direction perpendicular to the receiver path and to verify that the memory elements associated with each nozzle have been correctly programmed.

According to another aspect of the invention, a continuous printing system includes a printhead and a controller. The printhead includes a nozzle and a jet control element including a continuous heater element positioned to surround the nozzle. A plurality of three or more electrical contacts is in electrical communication with the continuous heater element. The plurality of three or more electrical contacts define a plurality of three or more continuous heater element portions that are actuatable with sufficient independence so as to control jet steering. The number of the continuous heater element portions equals the number of electrical contacts. A controller is configured to apply a waveform to at least one of the plurality of three or more electrical contacts to affect at least one of the plurality of independently actuatable continuous heater element portions.

BRIEF DESCRIPTION OF THE DRAWINGS

In the detailed description of the example embodiments of the invention presented below, reference is made to the accompanying drawings, in which.

DETAILED DESCRIPTION OF THE INVENTION

Figure 1:
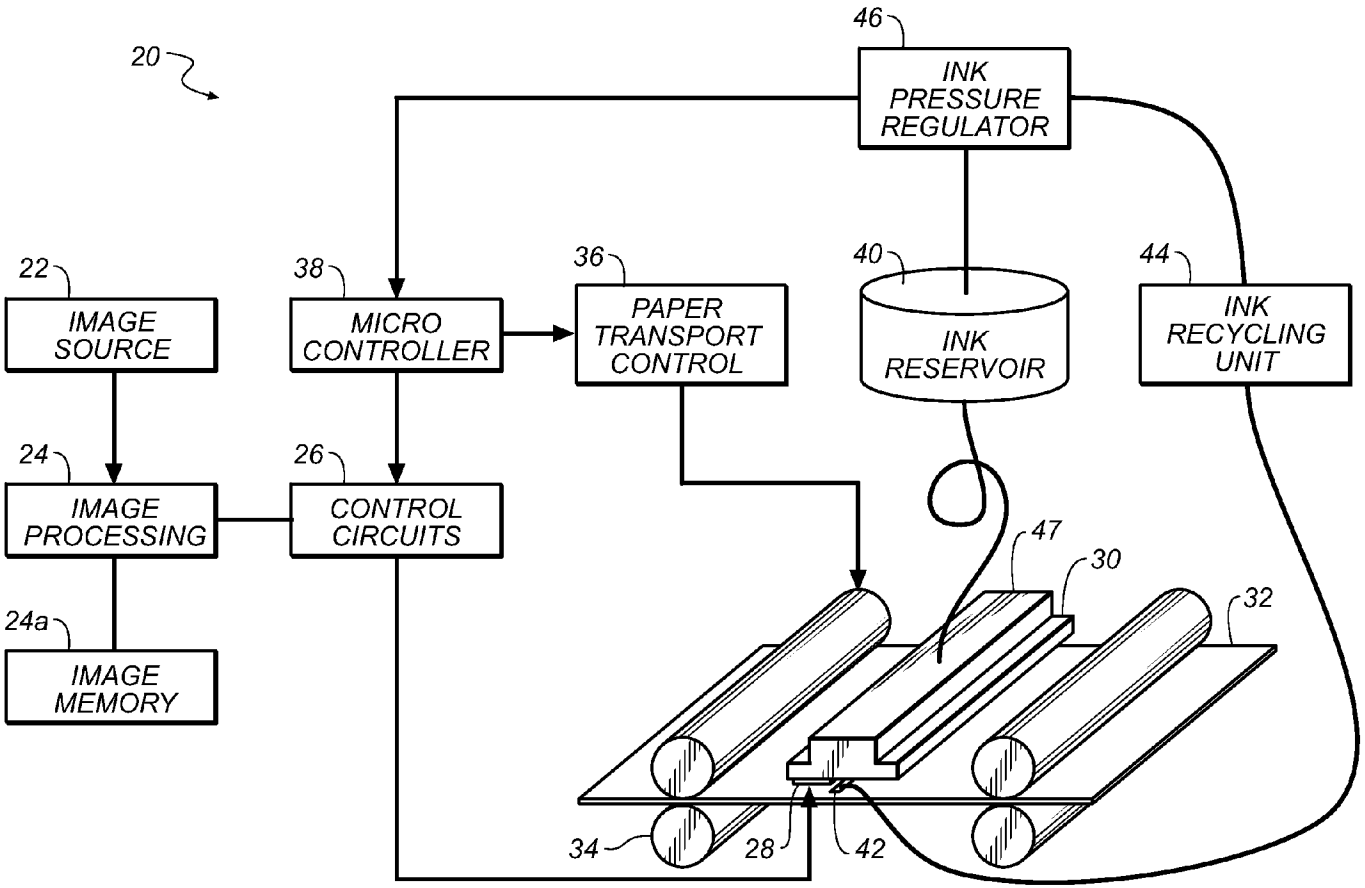
FIG. 1 shows a simplified schematic block diagram of an example embodiment of a printing system made in accordance with the present invention.

The present description will be directed in particular to elements forming part of, or cooperating more directly with, apparatus in accordance with the present invention. It is to be understood that elements not specifically shown or described may take various forms well known to those skilled in the art. In the following description and drawings, identical reference numerals have been used, where possible, to designate identical elements.

The example embodiments of the present invention are illustrated schematically and not to scale for the sake of clarity. One of the ordinary skills in the art will be able to readily determine the specific size and interconnections of the elements of the example embodiments of the present invention.

As described herein, the example embodiments of the present invention provide printing systems and printing system components typically used in inkjet printing systems and their operation. However, many other applications are emerging which use inkjet printheads to emit liquids (other than inks) that need to be finely metered and deposited with high spatial precision. As such, as described herein, the terms "fluid," "liquid," and "ink" refer to any material that can be ejected by the printing system or printing system components described below. Also, in the discussion presented below, the direction of the receiver path (often referred to as a "fast scan direction") is the direction of relative motion during fast scanning between a receiver and a printhead and is referred to as a "fast scan direction. Unless stated otherwise, the terms "along the nozzle array," "parallel to the nozzle array," "perpendicular to the receiver path," "perpendicular to the travel path of the receiver," and "slow scan direction" are used interchangeably.

As discussed above, a need exists to cost effectively provide altered pixel spacing in the direction perpendicular to the receiver path in order to provide secure documents. It would be advantageous if this could be done when desired and not done when not desired, in a document specific manner or within individual documents or pages of documents, so that the printer could be used in a conventional application when security was not needed. One way to accomplish an altered pixel spacing in the direction perpendicular to the receiver path is to rotate the printhead during printing, preserving a one to one correspondence between the native spatial nozzle density of the head and the pixel grid on the receiver, so that the density of the pixel grid perpendicular to the receiver path is increased by the inverse cosine of the angle of rotation. In some ways this is appealing because the process of manufacture of the printhead is not changed. The angle of change could be arbitrary, resulting in a change in the density pixel grid perpendicular to the travel path of the receiver to any value desired, so long as the new spatial density is greater than the spatial density when the printhead nozzle array is perpendicular to the receiver path. For example, the pixel grid could be changed from 1200 pixels per inch to 1200.5 pixels per inch. The mechanical operation of rotating the printhead physically could be done prior to printing of a document, or, if mechanical rotation means were very fast, between pages of the document. However rotation requires mechanical precision and generally is a slow process, and the ink delivery system could be slightly perturbed during rotation, which can result in unintended image artifacts. Rotation also alters the position of drops in the direction along the receiver path, so that drop timing might need to be altered in accordance with rotation, introducing system complexity. So while this technique is attractive, for example, in security printing, it is might not be a preferred solution across applications.

In accordance with the example embodiments of present invention, a pressurized ink source is used to eject filaments (jets) of fluid through a plurality of nozzles, equivalently called nozzle bores, from which continuous streams of ink drops are formed using drop forming devices associated with each nozzle bore. The drop forming devices are typically part of a jet control element associated with each nozzle bore. The ink drops are directed to an appropriate location using one of several types of deflection (electrostatic deflection, heat deflection, gas flow deflection, mechanical deflection, surface deflection, fluid velocity control, etc.) or a combination of those techniques. Regardless of the deflection method, the amount of deflection of the drops, typically measured in degrees of deflection angle, can be varied. One choice for the amount of deflection is no deflection at all or at most a very small amount of deflection. In one mode of operation, when no print is desired, the ink drops are caused to be "caught,"

that is they are deflected into an ink capturing mechanism (catcher, interceptor, gutter, etc.) and are either recycled or disposed of. When printing is desired, the ink drops are not deflected or are minimally deflected and allowed to strike a print media (receiver). Alternatively, deflected ink drops can be allowed to strike the receiver, while non-deflected or minimally deflected ink drops are collected in the ink capturing mechanism. In these operational modes, the direction of deflection has at least a component along the direction of the path of the receiver in order that selected drops may be directed to the catcher.

Figure 2:
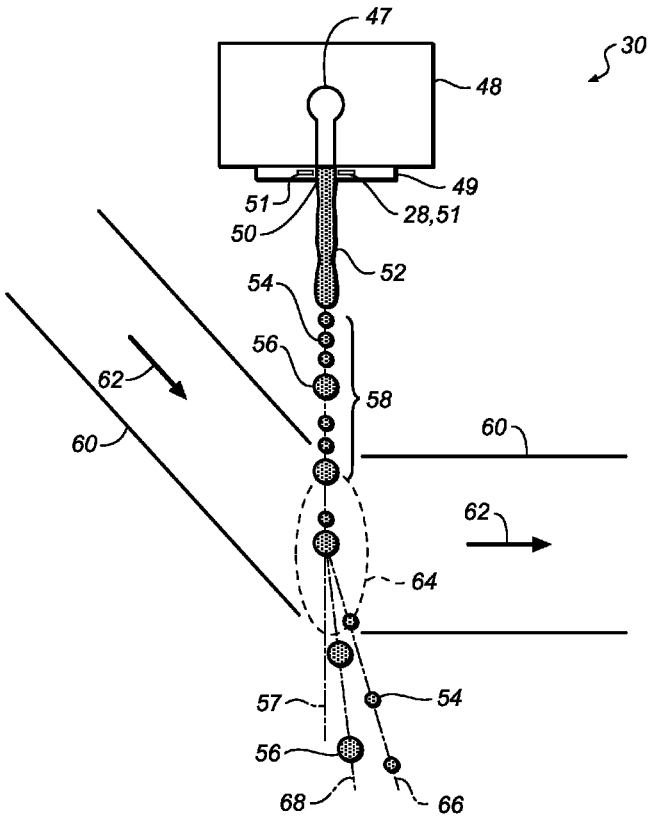
FIG. 2 is a schematic view of an example embodiment of a continuous printhead made in accordance with the present invention.
Figure 3:
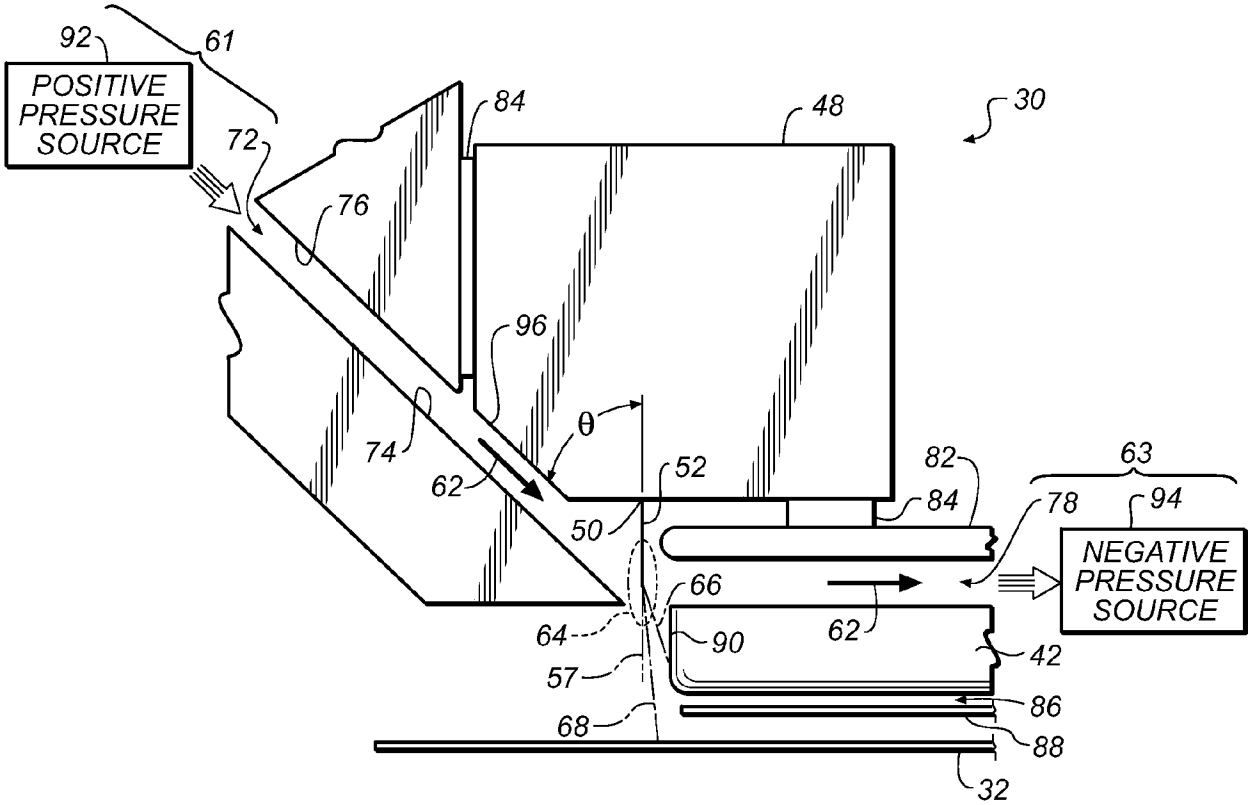
FIG. 3 is a schematic view of an example embodiment of a continuous printhead made in accordance with the present invention.

Referring to FIGS. 1-3, example embodiments of a printing system and a continuous printhead are shown that include the present invention described below. Although the example embodiment shown in FIGS. 1-3 includes a continuous printing system that uses a gas flow to differentiate between print and non-print drops, the present invention finds applicability in other types of continuous printing systems in which the primary motive energy for the creation of drops comes from the momentum of the traveling liquid in the liquid jet including, for example, the continuous printing systems described in one or more of U.S. Pat. No. 8,033,647; U.S. Pat. No. 8,033,646; U.S. Pat. No. 7,914,121; U.S. Pat. No. 7,914,109. The present invention also finds applicability in continuous printing systems that differentiate between print drops and non-print drops using other types of deflections mechanism, for example, electrostatic deflection mechanisms.

Referring to FIG. 1, a continuous printing system 20 includes an image source 22 such as a scanner or computer which provides raster image data, outline image data in the form of a page description language, or other forms of digital image data. This image data is converted to half-toned bitmap image data by an image processing unit 24 which also stores the image data in image memory 24*a*. A plurality of mechanism control circuits 26 read data from the image memory 24*a* and applies time-varying electrical pulses to a jet control element(s) 28 associated with one or more nozzles of a printhead 30. These pulses are applied at an appropriate time, and to the appropriate nozzle, so that drops are formed from a continuous ink jet stream caused selectively to form spots on a recording medium (receiver) 32 in the appropriate position designated by the data in the image memory 24*a*. The maximum rate of transferring the data needed to specify the printing of a drop onto recording medium 32 from the image memory to jet control element(s) 28 is the frequency associated with the maximum rate of drops that can be printed by each nozzle, i.e. the maximum print rate. A line head (not shown) comprises several printheads 30 in order to provide a plurality of modules 48 to print on wide receivers. Several printheads 30 may be incorporated in printer 20, for example to provide multiple colors or for the purpose of redundancy. Printhead 30 typically includes drop deflection means, a drop catcher, a nozzle plate, and an ink delivery system.

Recording medium (receiver) 32 is moved relative to printhead 30 by a recording medium transport system 34, which is electronically controlled by a recording medium transport control system 36, and which in turn is controlled by a microcontroller 38. The recording medium transport system shown in FIG. 1 is a schematic only, and many different mechanical configurations are possible. For example, a transfer roller could be used as recording medium transport system 34 to facilitate transfer of the ink drops to recording medium 32. Such transfer roller technology is well known in the art. In the case of page width printheads, it is most convenient to move recording medium 32 past a stationary printhead. However, in the case of scanning print systems, it is usually most convenient to move the printhead along one axis (the sub-scanning direction or slow scan direction) and the recording medium along an orthogonal axis (the main scanning direction or fast scan direction) in a relative raster motion.

Ink is contained in an ink reservoir 40 under pressure. In the non-printing state, continuous ink jet drop streams are unable to reach recording medium 32 due to an ink catcher 42 that blocks the stream and which may allow a portion of the ink to be recycled by an ink recycling unit 44. The ink recycling unit reconditions the ink and feeds it back to reservoir 40. Such ink recycling units are well known in the art. The ink pressure suitable for optimal operation will depend on a number of factors, including geometry and thermal properties of the nozzles and thermal properties of the ink. A constant ink pressure can be achieved by applying pressure to ink reservoir 40 under the control of ink pressure regulator 46. Alternatively, the ink reservoir can be left unpressurized, or even under a reduced pressure (vacuum), and a pump is employed to deliver ink from the ink reservoir under pressure to the printhead 30. When this is done, the ink pressure regulator 46 can include an ink pump control system. As shown in FIG. 1, catcher 42 is a type of catcher commonly referred to as a "knife edge" catcher. As shown in FIG. 3, catcher 42 is a different type of catcher commonly referred to as a "Coanda" catcher. The "knife edge" catcher shown in FIG. 1 and the "Coanda" catcher shown in FIG. 3 are interchangeable and either can be used usually the selection depending on the application contemplated. Alternatively, catcher 42 can be of any suitable design including, but not limited to, a porous face catcher, a delimited edge catcher, or combinations of any of those described above.

The ink is distributed to printhead 30 through an ink channel 47 in jetting module 48. The ink preferably flows through slots or holes etched through a silicon substrate of printhead 30 to its front surface, where a plurality of nozzles and jet control elements 28 are located. When printhead 30 is fabricated from silicon, all or a portion of the mechanism control circuits 26 can be integrated with the printhead. Referring to FIG. 2, a schematic view of continuous liquid printhead 30 is shown. Printhead 30 includes an array or a plurality of nozzles 50 formed in a nozzle plate 49 attached to jetting module 48. In FIG. 2, nozzle plate 49 is affixed to jetting module 48. However, as shown in FIG. 3, nozzle plate 49 can be an integral portion of the jetting module 48. Liquid, for example, ink, is emitted under pressure through each nozzle 50 of the array to form filaments or jets of liquid 52. In FIG. 2, the array or plurality of nozzles extends into and out of the figure. Nozzle plate 49 can be made of silicon and thus contain silicon logic elements such as transistors, resistors, etc as well as nozzles.

In accordance with the present invention, the printer comprises one or more printheads 30. Each of a plurality of nozzles 50 formed in a nozzle plate 49 of an associated jetting module 48 has an associated jet control element 28 on nozzle plate 49. Typically, nozzle plate 49 is made of silicon by fabrication technologies developed for semiconductor chip manufacture, but this is not required for the present invention. If nozzle plate 49 is made by silicon chip manufacturing technology, electrical elements such as logic, memory, conductive and resistive electrodes, transistors, etc can be made during the nozzle manufacturing process.

Figure 4A:
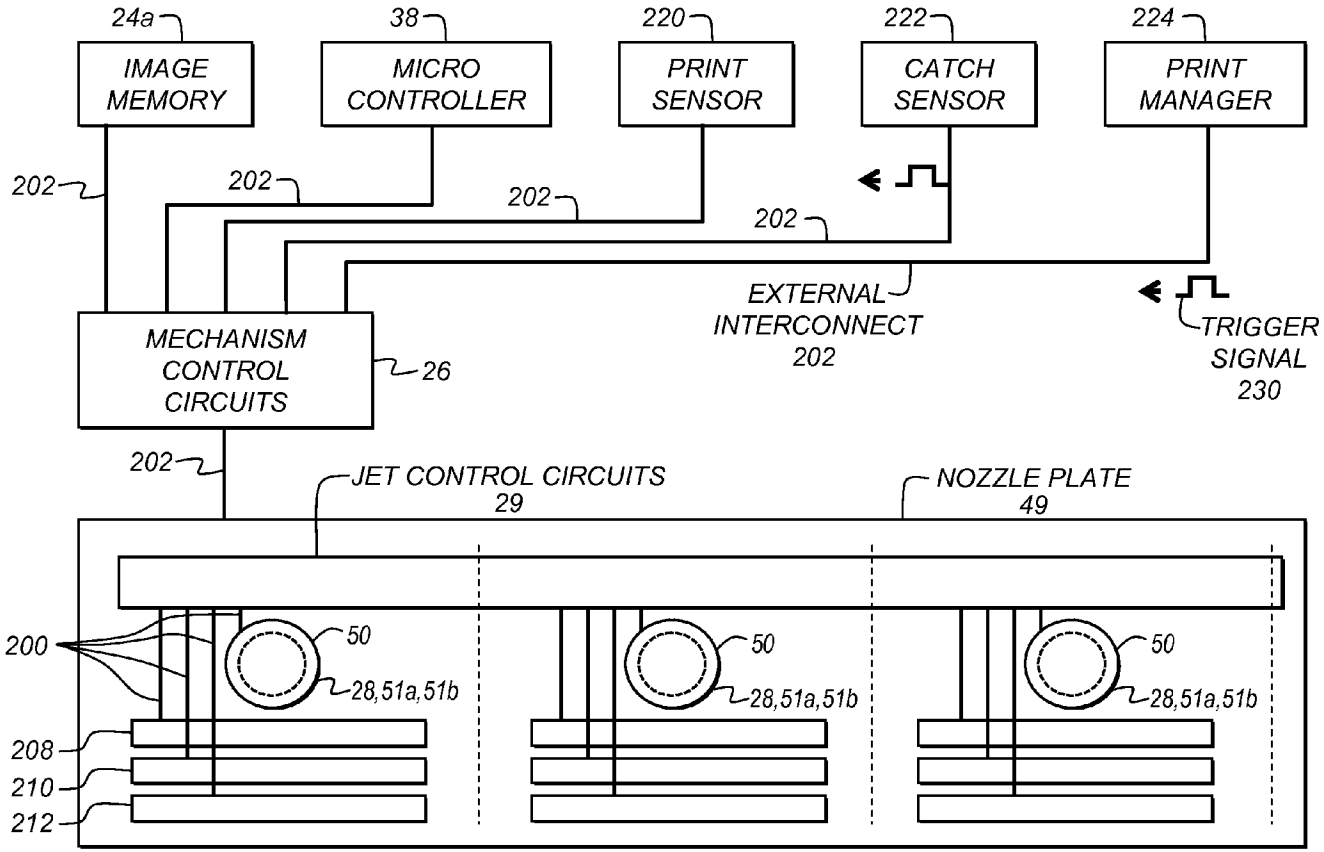
FIG. 4*a* shows a simplified schematic block diagram of an example embodiment of a printing system made in accordance with the present invention.

Jet control element 28 is capable of performing multiple functions associated with the continuous jet of fluid ejected from each nozzle 50 when selectively activated including drop formation to form drops from a continuous jet of liquid 52 associated with each nozzle, and finely tailored drop steering to alter the trajectory of the drops 54, 56 or of the jets (streams) 52 associated with each nozzle in an arbitrary direction with components either parallel or perpendicular to the paper path (or both). In some embodiments, the drop formation carried out by the jet control element 28 under the control of the jet control circuits 29 is in response to the image data and the drop formation carried out by the jet control element determines whether the drop will be directed toward the print media or be directed to the catcher. In other embodiments, jet control, for example, finely tailored drop steering, is accomplished using jet control element 28 while the formation of drops that will become print drops or catch drops is accomplished using other portions of the printhead, for example, a mechanical actuator such as a piezoelectric element. Finely tailored steering here refers to drop steering that can be controlled in a large number of very finely spaced stepwise increments over a small range of magnitudes in any direction (i.e. some combination of directions perpendicular and parallel to the receiver path, the amount of modulation typically ramped from nozzle to nozzle as will be discussed. Jet control circuit 29, as shown in FIG. 4*a*, typically includes electronic circuitry fabricated by VLSI circuit technology on nozzle plate 49, typically made of silicon, attached to jetting module 48. Jet control circuit 29 typically has a portion extending the entire length of nozzle plate 49 to facilitate communication via bidirectional external data lines 202 from mechanism control circuit 26 to each of the nozzles 50 on the nozzle plate 49. A portion of jet control circuit 29 is associated with each nozzle to facilitate data communication via bidirectional internal data lines 200 on nozzle plate 49 between jet control circuit 29 and jet control elements 51*a*, surrounding each nozzle, and between jet control circuit 29 and nozzle deactivation memory elements 208, reconfiguration data memory elements 210, and compressed reconfiguration data memory elements 212 which store data similar to reconfiguration data memory elements 210 but in compressed form or encrypted form.

Mechanism control circuits 26 read data from the image memory 24*a* and apply time-varying electrical pulses to jet control circuit 29 which determine the precise way in which drops are formed and drops are selected for printing or catching. Data which determine the precise way in which drops are formed and drops are selected for printing is read frequently from image memory 24*a*, typically at time intervals approximately equal to the time required for a receiver pixel to move its length in the direction of receiver motion under the printhead (pixel time or pixel time interval or pixel print time or pixel print time interval). Thus drops are formed from a continuous ink jet (stream) and some drops are selected to form spots on the recording medium (receiver) 32 in the appropriate position designated by the data in image memory 24*a*. The time-varying electrical pulses may repeat upon consecutive pixel print time intervals or may differ upon consecutive intervals, depending on the content of the image to be printed. Because these pulses may differ, mechanism control circuits 26 must read data from the image memory 24*a* very frequently, that is at time intervals about equal to the time required for a receiver pixel to move its length in the direction of receiver motion (pixel time or pixel time interval or pixel print time or pixel print time interval). In some cases of continuous inkjet printing, the data in the image memory is read once for each pixel passing beneath the nozzles; in other cases, for example when many drops are printed in a single pixel or when drops with small volumes are formed for catching, the data may be read from the image memory 24*a* several, typically two to four, times during passage of a pixel beneath the nozzles. In either of these cases, data is exchanged rapidly between image memory 24*a* and jet control circuitry 29 rather than only occasionally, for example at time intervals much greater than those required for a receiver pixel to move its length in the direction of receiver motion, because image content frequently changes from one pixel to the next.

Also, in accordance with the present invention, data is provided from finely tailored drop steering reconfiguration data memory elements 210 associated with each nozzle on nozzle plate 49 to jet control circuit 29, specifying the amount and direction of the finely tailored drop steering for each nozzle. Time-varying electrical pulses applied periodically by jet control circuit 29 to jet control element 28; 51*a*, for example, drop control heater elements 51*b*, determine not only drop formation and selection, but also the direction and amount of finely tailored drop steering. Although the electrical pulses applied to jet control elements 28; 51*a* for drop formation and selection often change, at least within the time for a receiver pixel to pass under the head in the direction of the receiver path, the electrical pulses applied to jet control elements 51*a* for finely tailored drop steering typically repeat many times before changing (typically thousands to millions of times). Because these pulses rarely differ, it is advantageous to the store the reconfiguration data that characterizes the finely tailored steering in memory circuitry, preferably reconfiguration data memory elements 210 that is located on the nozzle plate. The jet control circuit 29 can then receive data characterizing finely tailored drop steering for each nozzle directly from the reconfiguration data memory elements 210, via internal data interconnects 200. In this way, the amount of data read per second communicated by the mechanism control circuits 26 to the jet control circuit 29 is kept from being impractically large, since, as will be discussed, the amount of data required to specify the magnitude and direction of finely tailored drop steering is very large, typically very much larger than that required for specifying drop formation. Since the direction and amount of finely tailored drop steering repeats, this information can be practically stored on reconfiguration data memory elements 210 associated with each of the plurality of nozzles 50 on nozzle plate(s) 49.

As shown in FIG. 4*a*, finely tailored drop steering reconfiguration data memory elements 210 are preferably located on nozzle plates 49. These memory elements are updated from time to time, at intervals that are larger when compared to the pixel time interval. Between updates, the reconfiguration data in the reconfiguration data memory elements 210 causes the jet control circuit 29 to alter the ratio of power of the electrical pulses to be applied to individual jet control elements 51*a* by jet control circuit 29 to control each drop formed at each associated nozzle to provide identical finely tailored drop steering until the reconfiguration data memory elements 210 are updated (or reprogrammed or rewritten or reloaded with new data) to specify a new series of time-varying electrical pulses corresponding to new data for finely tailored drop steering for each drop formed.

The command to reprogram finely tailored drop steering reconfiguration data memory elements 210 causes a subsequent change in the finely tailored drop steering. The data updating reconfiguration data memory elements 210 (and hence specifying new data for finely tailored drop steering) passes through jet control circuit 29 but may originate from any source, including, but not limited to, image source 22, image processing unit 24, or physical sensors 220, physical sensors 222, or external print manager interface 224, as will be discussed.

As shown in FIG. 4*a* and FIG. 2, image data from image source 22, which provides original raster image data, is rendered, for example to half-toned bitmap image data, by image processing unit 24, which also stores the rendered image data in image memory 24*a*. The nature of this rendering process, in the method of the present invention to be described, can be changed each time new finely tailored drop steering data are loaded into the finely tailored drop steering reconfiguration data memory elements 210. Thus it is important that the mechanism control circuits 26 can read data from the image memory. It is advantageous that this data is read very infrequently, that is at time intervals very much larger than the pixel time interval, which is the time required for a receiver pixel to move its length in the direction of receiver motion.

As noted, finely tailored steering refers to drop steering that can be controlled in a large number of very finely spaced stepwise increments over a small range of magnitudes in any direction (i.e. some combination of directions perpendicular and parallel to the receiver path), the amount of steering being ramped slightly from nozzle to nozzle, as will be discussed. The concept of a pixel grid previously described is used in analyzing implementation of finely tailored drop steering in the example embodiments.

In one example embodiment of the invention, a printer system is provided with enhanced performance features as well as improved reliability and build cost, as will be described, by using finely tailored drop steering having steering components both parallel and perpendicular to the paper path. This object is accomplished in a first example embodiment by using finely tailored drop steering in a direction perpendicular to the receiver path to 'unobservably' reconfigure, during printing, the receiver pixel grid in the direction perpendicular to the receiver path. By way of example, such reconfiguration might be user-selected to occur for a particular portion along the direction of the receiver path, for example in roll to roll printing for a portion comprising a page(s) or a paragraph(s), of a book being printed. In accordance with the present invention, those page(s) or a paragraph(s) would be printed with a very slightly reconfigured receiver grid in the direction perpendicular to the receiver path. By way of numerical example, if the initial receiver grid for the document were 1200 by 1200 pixels per inch (in the directions substantially perpendicular and parallel to the receiver path, or in the slow and fast scan directions, respectively) as is common in printed reading material, the reconfigured grid, in accordance with the present invention, would differ only very slightly from the initial grid in the direction perpendicular to the receiver travel path. The reconfigured grid might be, for example, 1199 by 1200 pixels per inch or 1199 by 1199 pixels per inch. These changes in spatial density of the printed grid are very slight, typically less than a part in a thousand. They are much less than any grid reconfiguration taught in prior art printer systems. As noted, alteration of the pixel grid has been practiced along the receiver path and aims to maximize speed or resolution and hence such grid changes are very large, typically 25-400%, and are generally human-reader observable. The term 'unobservably reconfigure' is here used to indicate that the reconfiguration change would not be easily visible to the human eye viewing the printed receiver, a feature advantageous to printer performance, for example in print watermarking. Such unobservable changes are not aimed to maximize speed and resolution. Advantageously, in the example of print watermarking; the material printed with the unobservable reconfiguration would only be machine detectable, enabling document tagging, identification, and reproduction security, as will be discussed. In the example of print watermarking, the selection of the portion of the printed document to be tagged by printing onto a reconfigured grid could be predetermined in the original image file if desired. Alternatively, the selection of the portion of the printed document to be tagged could be selected by the (human) manager of the printing operations, either deliberately or at random. It is contemplated in the current invention that the receiver grid, for example a grid of 1200×1200 pixels per inch, could be reconfigured to a first reconfigured grid, for example a grid of 1199×1200 pixels per inch, and then could be reconfigured a second time to a second reconfigured grid, for example a grid of 1200×1200 pixels per inch, which in this example would return the printer to its original state. These changes would each preferable occur after a page (paragraph) had been printed in either the first or second reconfigured state, in order that time could be allotted to reprogram the reconfiguration data memory elements. It is also contemplated in the current invention that the receiver grid might be reconfigured any number of times during the printing of a document. In some embodiments the reconfiguration data memory elements 210 can store more than one set of reconfiguration data to enable for rapid changes between multiple reconfiguration grid resolutions without the need to transmit significant amounts of reconfiguration data from the mechanism control circuits 26 to the jet control circuits 29. Reconfiguring means changing the receiver pixel grid, either to a new configuration or to the original configuration.

The technique of 'unobservable' reconfiguration of the receiver grid in the direction perpendicular to the receiver path is now described and is seen to reside in software logic changes that alter the electrical pulse patterns communicated to the printhead, rather than in hardware changes. The technique is best understood by considering the events which could trigger an "unobservable reconfiguration" change in the pixel grid in the direction perpendicular to the receiver path. It is assumed in the discussion that a document, whose image data is contained in image source 22, is being printed by continuous printer system 20, the document having started printing at a particular print time pt0. The native nozzle density of the plurality of nozzles 50 fabricated in plates 49 is typically on the order of 600-2400 pixels per inch. Each nozzle plate 49 (here taken to be identically made) is a part of print module 48. According to the first example embodiment of the present invention, at a print time pt1>pt2, a reconfiguration trigger signal 230, shown as a pulse in FIG. 4*a*, triggers the process of unobservable reconfiguration of the receiver grid. For the purpose of the present discussion, trigger signal 230 is provided to initiate a watermark in the printed document, although many other purposes are contemplated within the current invention. The trigger signal is typically derived from one of several sources: either from specific image source data 22, embedded for example in the page description language of the document, or from a special data line or data pattern or computational algorithm computed by microcontroller 38, or from physical sensors 220 (observing the printed image) or 222 (observing the catcher), or from a human manager of the printing operations (224). These possible originators of trigger signal 230 are shown in FIG. 4*a* on the top line as being transmitted via bidirectional external data interconnects 202. For example, an algorithm executed by microcontroller 38 might be configured to might trigger reconfiguration of the receiver grid by sending reconfiguration trigger signal 230 on page three of each document. Alternatively, the trigger signal timing could depend on the number of documents of a particular kind that have already printed, so that during the first document, the receiver grid is reconfigured on the first page, on the second document, the second page, etc., a document tagging procedure well known in the art of secure document tracking. Alternatively, the trigger signal 230 could be caused to occur at a random page of the document by data from microcontroller 38 or data contained in image memory 24*a*.

It is advantageous, according to the example embodiment, that the trigger signal 230 occur between the printing of pages (paragraphs), so that the data transfer actions required to reconfigure the receiver grid, by data transfer to the finely tailored drop steering reconfiguration data memory elements 210, have time to complete before a new page (paragraph), is printed. This can be understood from the need to transfer a large amount of data to program the finely tailored drop steering reconfiguration data memory elements 210 and from the fact that that the trigger signal can occur, in accordance with the present invention, during high speed printing of a page or document. As noted, finely tailored drop steering refers to drop steering that can be controlled in a large number of very finely spaced stepwise increments over a small range of magnitudes in any direction (i.e. some combination of directions perpendicular and parallel to the receiver path)), the amount of steering being typically ramped from nozzle to nozzle. If activated by a human print system manager, the trigger signal 230 is advantageously delayed until the occurrence of a page (paragraph) by microcontroller 38 so as to provide time for transferring reconfiguration data without interrupting printing. The trigger signal 230 arrives as electrical pulse(s) from control circuitry 26 through the jet control circuitry 29 to jet control mechanism 28 on nozzle plates 49 of print modules 48, the circuitry having finely tailored drop control reconfiguration data memory elements 210 which are written to or loaded to repeatedly provide, again and again, until they are reloaded, the information needed by each nozzle for unobservable reconfiguration of the receiver grid until another trigger signal alters or reconfigures data memory elements to subsequently reconfigure the receiver grid. Thus the trigger signal 230, whatever its origin, initiates the process of unobservable reconfiguration of the receiver grid.

The first step in the reconfiguration process is the selection of a particular nozzle or of a set of nozzles for deactivation, meaning that the nozzles so selected will be no longer print drops, for example selected nozzles might be caused to produce only drops that are captured by the catcher, by any one of a number of means. For example, drops from the selected nozzles could be electrostatically deflected into a catcher by application of strong electric fields that would cause the drops from the selected nozzle always to be caught. Alternatively, a mechanical contact with the continuous stream of the nozzle selected or with drops broken off from the continuous stream could be activated to cause drops from the selected nozzle always to be caught. Alternatively, electro-hydrodynamic steering of the jet itself, before drop break-off, could be employed to cause drops from the selected nozzle always to be caught. If the reconfiguration were desired to be permanent, many other nozzle deactivation means are possible; including electroplating or other mechanical means of valving off the flow of ink to the nozzle to be deactivated. The selected nozzles are preferably spaced evenly along the printhead 30 along each nozzle plate 49, for example spaced at intervals of from about 0.5 to 4 inches. In the example embodiments discussed, the selected nozzles are spaced approximately one inch apart. Since typically the native nozzle density of printheads is about 1000 nozzles per inch, the nozzles selected for deactivation are preferably spaced about 100 to 10000 nozzles apart. However other spacings are also effective in the practice of the present invention. When a nozzle is deactivated in a continuous inkjet printing system by causing all drops to be caught, it may be desirable to adjust the position of landing on the catcher of the deactivated nozzle and also the landing positions of caught drops whose associated nozzles are near to the deactivated nozzle, since the flow of liquid on the catcher and the airflow near the catcher will be slightly altered by such deactivation. This can be accomplished, if desired, by technology to be later described. This step of deactivating a nozzle is not required if the pixel grid density is to be increased rather than decreased.

In order that the selected nozzles remain deactivated during the period of grid reconfiguration, the trigger signal 230 causes deactivation memory elements 208 associated with each nozzle to be set from an initial active state, here assumed to be represented by a stored "1," to an inactive state, here assumed to be represented by a stored "0." The microcontroller 38 is programmed to communicate with deactivation memory elements 208 to program "1s" or "0s" in deactivation memory elements 208. The deactivation means associated with each nozzle, for example electro-hydrodynamic deactivation means or mechanical valving means, acts in accordance at all times with the deactivation memory elements 208 associated with each nozzle 50. All nozzles may be initially active ("1" state") and the trigger signal 230 causes a selected few nozzles to be 'programmed' to be inactive ("0" state) until/unless deactivation memory elements 200 are rewritten by microcontroller 38 to a "1" states.

Figure 4B:
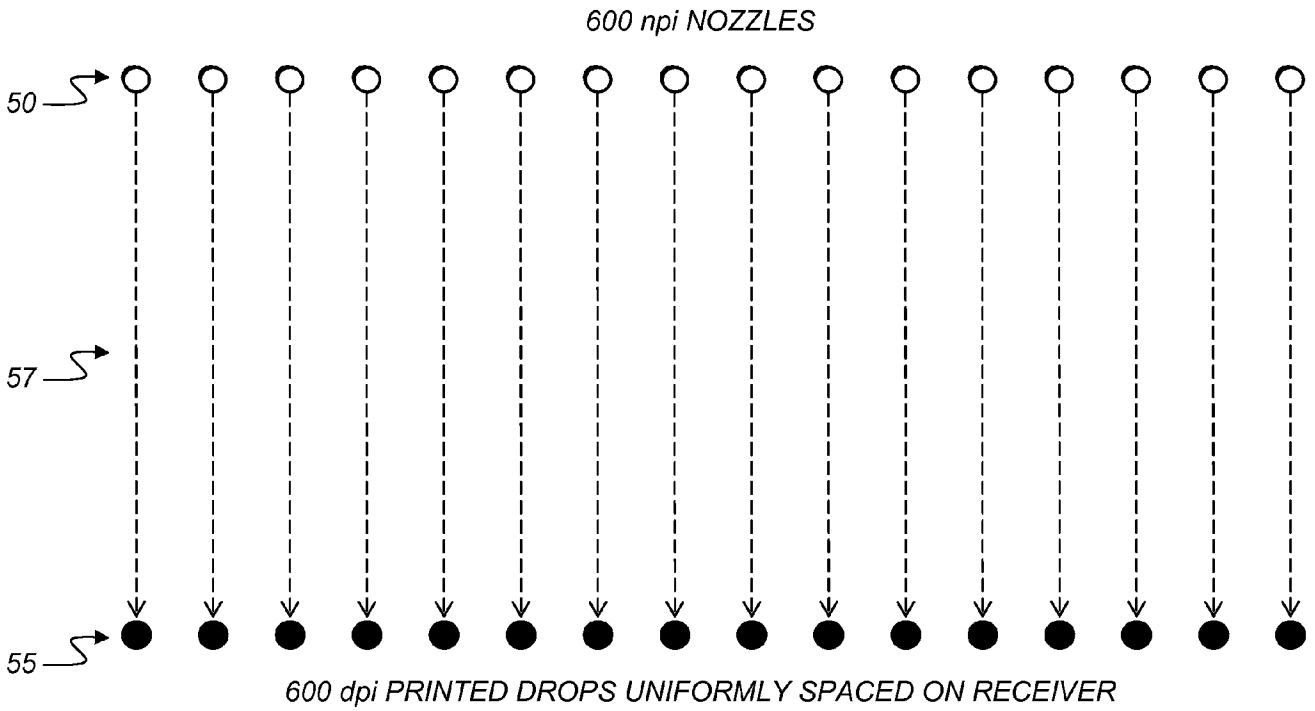
FIG. 4*b* shows trajectories of drops from a nozzle array to the print locations on the print media with the nozzle array having a spatial density of 600 nozzles per inch and the jets being ejected perpendicularly to the nozzle plate.
Figure 4C:
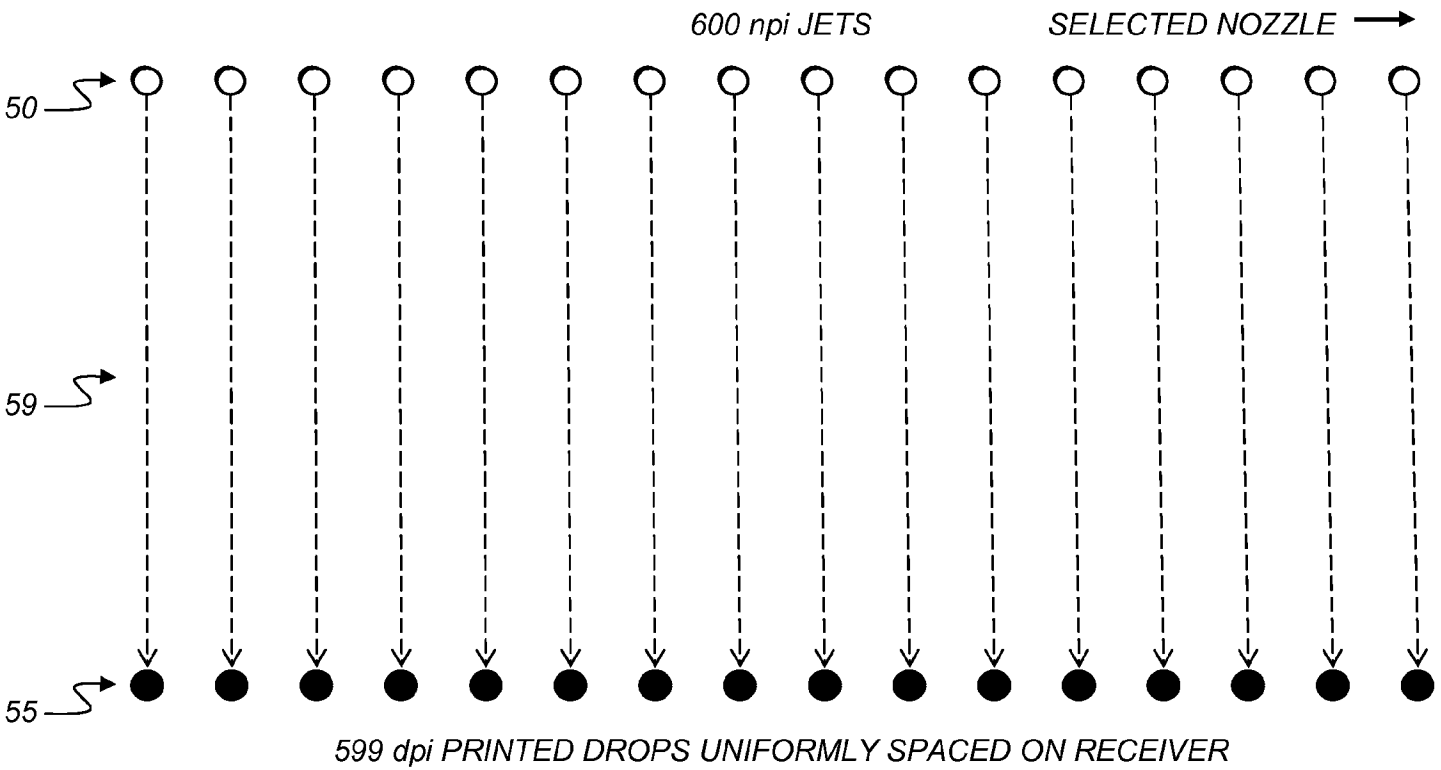
FIG. 4*c* shows trajectories of drops from a nozzle array having a spatial density of 600 nozzles per inch to print locations having a spatial density of 599 pixels per inch with the jets being ejected at a very slight angle to the nozzle plate.
Figure 4D:
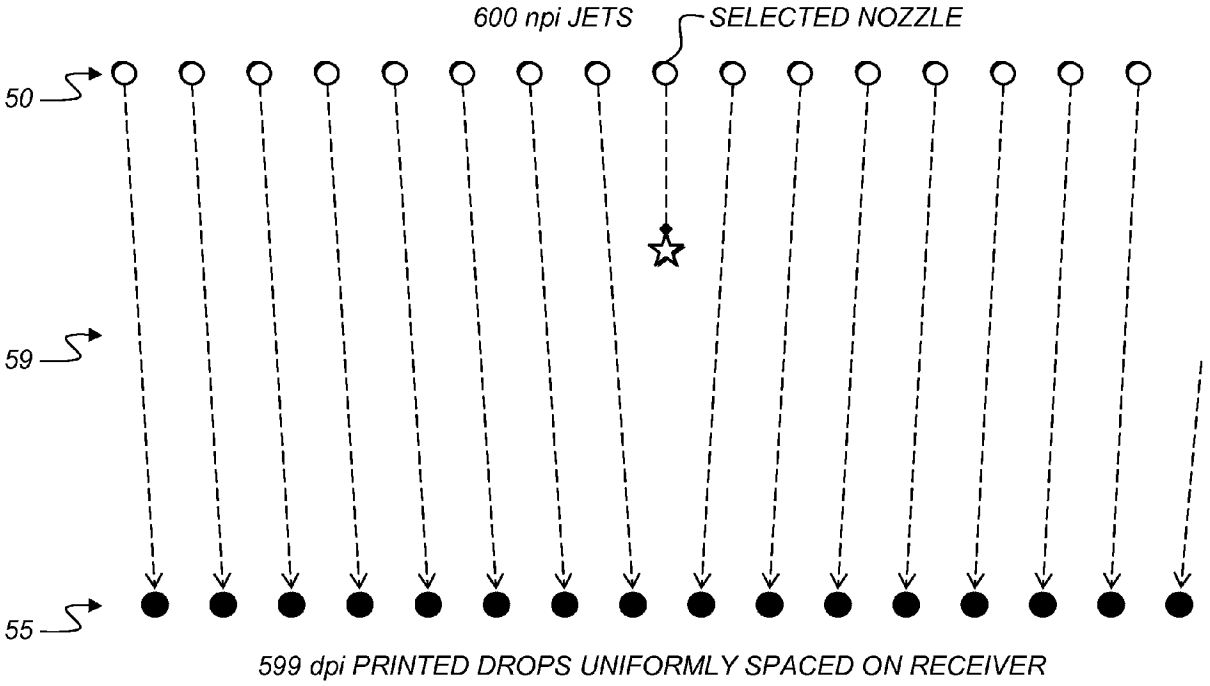
FIG. 4*d* shows trajectories of drops from a nozzle array having a spatial density of 600 nozzles per inch to print locations having a spatial density of 599 pixels per inch in which one nozzle has been deactivated.

The second step in the process of unobservable reconfiguration of the receiver grid is a programming of the finely tailored steering reconfiguration data memory elements 210 associated with each nozzle and located on the nozzle plate(s) 50. This data programming, typically specified by microcontroller 38, results in this embodiment in a memory state of each of the finely tailored steering reconfiguration data memory elements 210 which causes each nozzle to be steered in a direction perpendicular to the receiver path in accordance with the data stored in reconfiguration data memory elements 210. The data for finely tailored drop steering is computed, typically, by microcontroller 38 using an algorithm that takes into account which nozzles are selected for deactivation. As shown in FIGS. 4*b*, 4*c*, and 4*d*, the steering angle from nozzle to nozzle decreases in accordance with this algorithm inversely and linearly with distance from the nozzle selected for deactivation, in order that the spatial density of printed drops in the direction perpendicular to the receiver path be uniform in the vicinity of the nozzle selected for deactivation. FIG. 4*b* shows the trajectories of drops travelling from the nozzles 50 of the nozzle array to the print locations 55 on the print media. The nozzle array has a spatial density of 600 nozzles per inch and the print locations on the print media have the same spatial density. The jets are ejected perpendicularly to the nozzle plate. FIG. 4*b* is shown before reconfiguration of the pixel grid in the direction perpendicular to the receiver path. FIG. 4*b* would look identical centered on any nozzle, since the native nozzle spacing and the pixel grid in the direction perpendicular to the receiver path are identical and uniform along the entire printhead(s). In FIG. 4*b*, the density of the uniform pixel grid in the direction perpendicular to the receiver path is 600 dpi. FIG. 4*c* shows the trajectories of drops travelling from the nozzles 50 of the nozzle array to the print locations 55 on the print media. after reconfiguration of the pixel grid in the direction perpendicular to the receiver path. FIG. 4*c* is centered at a location away from the nozzle selected for deactivation by about 250 nozzle spacings in accordance with the present invention. The deactivated nozzle is located on the right side of FIG. 4*c*. The density of the pixel grid in the direction perpendicular to the receiver path in this example is 599 dpi. The algorithm used by the microcontroller in this example ensures that the locations of all the drops that can be printed on the receiver (corresponding to the receiver pixel grid in the direction perpendicular to the receiver path.) are evenly spaced with a spatial density one less than the original spacings of the pixel grid in the direction perpendicular to the receiver path over a distance along the nozzle array of about one inch. However, the angles of the jets would not look the same if the illustration were centered at a location nearer the nozzle selected for deactivation, as shown in FIG. 4*d*. FIG. 4*d* shows the trajectories of drops travelling from the nozzles 50 of the nozzle array to the print locations 55 on the print media after reconfiguration of the pixel grid in the direction perpendicular to the receiver path but at a location showing the nozzle selected for deactivation. The trajectory of the drops from the deactivated nozzle terminates between the nozzle and the print location of on the print media to indicate that all the drops from the deactivated nozzle are directed toward the catcher. The density of the pixel grid in the direction perpendicular to the receiver path in FIG. 4*d* in this example is 599 dpi, just as in FIG. 4*c*. The deflection of the drops in FIG. 4*d* (measured either by the angle of finely tailored drop deflector in comparison to the angle of the jet relative to nozzle plate in the absence of finely tailored drop deflector or, equivalently, by the displacement of the position of the printed drops on the receiver compared to the positions in the absence of finely tailored drop deflection) is small, but greater than in FIG. 4*c*. This is because the algorithm for finely tailored drop steering calls for a deflection of the position of the printed drops on the receiver, from the position they would otherwise have had, for the nozzles on either side of the nozzle selected for deactivation, the deflection being largest for nozzles near the deactivated nozzle. The deflection is directed toward the deactivated nozzle and hence differs in direction by 180 degrees for the nozzles on either side of the nozzle selected for deactivation.

The nozzles farther from the nozzle selected for deactivation are deflected less, typically in linear measure of their distance from the deactivated nozzle. Thus the nozzles second on either side of the nozzle selected for deactivation are deflected very slightly less than the nozzles neighboring the deactivated nozzle. The deflection algorithm in this example (magnitude of finely tailored drop steering disposed symmetrically on either side of the deactivated nozzle over a total distance of 1 inch) provides for a deflection such that the change in position, due to finely tailored drop steering, of drops on the receiver equals $+-(D*1_0/2-N)/(D*1_0-1)$ inches from the position they would have had in the absence of finely tailored drop steering, where the sign is taken such that the deflection of each nozzle is directed towards the nozzle selected for deactivation. In this formula, D is the spatial density of the original pixel grid in the direction perpendicular to the receiver path, assumed to equal the printhead nozzle spatial density (npi), N labels the distance, measured in units of the nozzle to nozzle spacing, of nozzles from the deactivated nozzle, and $1_0$ is one inch for dimensional consistency. In this example, if npi=D=600 per inch, then the two nozzles nearest the deactivated nozzle (labeled N=1) are deflected (600/2−1)/(600*599) inches in magnitude. The deflection is zero after (600/2) nozzles on each side of the nozzle selected for deactivation ($D*1_0/2=N=300$). For nozzles between 1 and 300 from the deactivated nozzle, the deflection is reduced by $1/(D*(D*1_0-1))$ from nozzle to nozzle. Generally, in accordance with the present invention, the deflection is caused to be ramped down uniformly from nozzle to nozzle away from the deactivated nozzle subject to the condition that the distance between the drops printed by the two nozzles nearest the deactivated nozzle is the same as the distance between any of the adjacent printed drops up to a nozzle count away from the deactivated nozzle for which the deflection is zero. The reconfigured pixel spacing on the receiver in the direction perpendicular to the receiver path is $1/(D-1/1_0)$, only slightly smaller than the original value of 1/D, on either side of the deactivated nozzle for nozzles up to a count of $D*1_0/2$ away from the deactivated nozzle, corresponding to a pixel density on the receiver in the direction perpendicular to the receiver path of $(D-1/1_0)$. In this example the distance over which the pixel grid on the receiver is reconfigured is one inch and the reconfiguration is symmetrical about the deactivated nozzle. (Note that here and elsewhere, if D were considered to be a unitless number measuring the pixel count over a distance of one inch, the term $1_0$ would not be necessary, as is well known in dimensional analysis.)

The entire printer can be uniformly reconfigured to a receiver pixel density of $(D-1/1_0)$ in the direction perpendicular to the receiver path by deactivating a nozzle every inch. For example, as can be appreciated by designers of printing systems, if each nozzle plate has nozzles extending over a length of 4 inches, and if four nozzles are selected for deactivation, symmetrically spaced along the printhead every one inch, the algorithm discussed above reconfigures the receiver pixel grid spacing in the direction perpendicular to the receiver path to be $1/(D-1/1_0)$ per inch uniformly over the entire printed length.

As another example, if the nozzle spatial density npi=2400 nozzles per inch and the original pixel grid in the direction perpendicular to the receiver path D=2400 pixels per inch, then the reconfigured pixel grid in the direction perpendicular to the receiver path is 2399 per inch for the example algorithm in which the distance over which the pixel grid on the receiver is reconfigured is one inch and the reconfiguration is symmetrical about the deactivated nozzle. Likewise, the distance between deactivated nozzles L can differ from one inch, the reconfigured spatial density of the pixel grid being less than it would be if L=1 inch, where L is the distance between deactivated nozzles. In the above example for D=2400, the reconfigured pixel grid density would be 2400-0.5 per inch for L=two inches. In this example, the deflection difference from nozzle to nozzle would be about half as large as for the case of L=1 inch. Generally the deflection difference from nozzle to nozzle would be $1/((D*(D*L-1))$ for L not equal to one inch and for the case that finely tailored drop steering is symmetrically disposed about the deactivated nozzle. Also, in general, the nozzle count over which the finely tailored drop steering is not zero on either side of a deactivated nozzle need not be the same. If Nr and N1 represent the number of nozzles, over which the finely tailored drop steering is not zero on either side of a deactivated nozzle, the deflection is reduced from nozzle to nozzle by $L/(Nr+N1-1)-1/D$ where L is the distance of pixel reconfiguration on the receiver and D is the receive pixel density before reconfiguration.

In order that the active nozzles remain steered during the period of grid reconfiguration, the trigger signal causes the finely tailored steering memory elements associated with each nozzle be set from their initial state, here assumed to be 'no steering' to a reconfigured state, here assumed to correspond to steering in the amount given by algorithms that provide a uniform spatial density of the reconfigured pixel grid in the direction perpendicular to the receiver path. The finely tailored steering memory elements 208 associated with each nozzle act in accordance at all times with the deactivation memory elements 202 associated with each nozzle. If all of the nozzles are initially not subject to finely tailored drop steering, and the trigger results in nearly all the nozzles to be steered in accordance with finely tailored drop steering data in a ramped fashion.

To understand the advantages of reconfiguring the receiver pixel grid, one may envision that a document is printed simultaneously on two different printers, one having a native nozzle density of, for example 1200 nozzles per inch and a receiver pixel grid of 1200 by 1200 pixels per inch, and the other, having a native npi of 1199 nozzles per inch and a receiver pixel grid of 1199 pixels per inch by 1199 pixels per inch. The hardware of the two printers would be very similar in build, cost, performance etc. and the two documents, to the human eye, would appear the same. If now at some point in the first document, say after page 3 ends, page 4 from the second document is substituted for page 4 of document 1, then the altered document is the same as that envisioned in the present invention assuming the first trigger occurs after page 3 and the second trigger after page 4. (Whether or not the pixel grid of the second printer is 1199 pixels per inch by 1199 pixels per inch or 1199 pixels per inch by 1200 pixels per inch is immaterial to the argument, as would be appreciated by one skilled in the art of digital printing, since the present invention enables changes in the receiver pixel grid in the direction perpendicular to the receiver path.)

It is within the scope of the present invention, although not required, that the reconfigured spatial grid can be achieved by selecting nozzles for deactivation that are not uniformly spaced, and that the number of such nozzles can differ from one nozzle plate to the next in line heads having multiple nozzle plates or from one line head to another. In such cases, the finely tailored drop steering amounts are chosen so that the reconfigured pixel density in the direction perpendicular to the receiver path is constant. It is also within the scope of the present invention that the reconfigured pixel density in the direction perpendicular to the receiver path may vary along the printhead or line of printheads or from one printhead to another.

It is also within the scope of the present invention, although not required, that at some time after the first trigger signal, for example after an integer number of pages (paragraphs) after the first trigger signal, a second trigger signal returns the printer system to its initial state. If so, then only a portion of the document printer is printed in the unobservable reconfiguration of the pixel grid and a machine measuring the receiver pixel grid in the direction perpendicular to the receiver path would detect a change in only an integral number of pages (paragraphs).

Additionally within the scope of the present invention, the trigger signal can cause image processing unit 24 to recalculate or re-rasterize the data in the image source 22 and resave the recalculated data in image memory 24*a*, for example in a binary file, in a way appropriate to the print system with the reconfigured receiver grid. This new data replaces the old data only for drops to be printed after the first trigger. It is important that this process be implemented in very fast circuitry, in order that the printing process not be interrupted. For example, if the trigger signal occurs at the end of printing of one page, it is desirable that the re-rasterization process occurs in real time, meaning sufficiently fast that by the time the next page is printing, the re-rasterization process is ahead of and stays ahead of the printing process. Many well know algorithms can be used to speed up the re-rasterization process, since re-rasterization pixel grid is very close to the original pixel grid, typically differing by less than one percent.

It is import to note, in accordance with the present invention but in contrast to the teaching of prior art, the reconfigured printer prints data at a reduced spatial density of the receiver pixel grid in the direction perpendicular to the receiver path, much as if the original hardware was built with a slightly different nozzle density or pitch. However, the nozzle density is that of the original printhead, since all changes caused by the first trigger are software or logic pulse changes, not hardware changes. Thus, unobservable reconfiguration is seen to break the one to one correspondence between the positions of the printed drops and the native nozzle density. Reconfiguration of the positions of printed drops which does not preserve a correspondence between the native nozzle density and the receiver grid is not practiced in the art. Also unknown in the art is the continuous ramping of the amount of drop steering associated with the nozzles responsible for consecutive adjacent printed drops as here practiced.

While prior art provides for drop steering drops so as to correct for placement inaccuracies of misdirected nozzles, the prior art does not contemplate changing the pixel spacing in the direction perpendicular to the receiver path over an extended distance along the nozzle array including the entire nozzle array length (in the direction perpendicular to the receiver path) nor do the teachings address changes in spatial density of the receiver pixels in the direction perpendicular to the paper path which are only a small fraction of the original spatial density of the receiver pixels in the direction perpendicular to the paper path. The current invention preferably changes the spatial density of the receiver pixels in the direction perpendicular to the paper path by 1 pixel per inch, or generally less than 5 pixels per inch in order that the changes be nearly invisible to the human reader. For a printer with a pixel grid density of 1200 pixels per inch, a change of 1 pixel per inch is less than 0.1 percent.

The opportunity to reconfigure the effective printed dpi in a manner nearly undetectable to the human eye can be exploited both for information encoding and image artifact suppression. This is due to the fact that an accurate measuring device, such as a precision optical sensor, could easily detect a change in printed pixel grid even as small as a change from of 1200 to 1199 pixels per inch in either direction, because the accuracy of construction and calibration of sensors is at least equal to the accuracy of construction of nozzle arrays made in silicon. The combination of document pages printed in a way unobservable to the human eye yet machine detectable is an advantageous feature of secure document printing, as is well known in the art of security printing. For example, many reproduction devices such as other ink jet printing systems or even electrophotographic printers, are based on receiver pixel grids of standard, unchangeable dimensions, such as 1200 by 1200 pixels per inch. Therefore, an attempt to copy a document printed in accordance with the current invention would produce a document made which could easily be detected as an 'illegal' copy by machine readers, even simple hand help scanners, because the number of printed dots per inch is easily ascertained exactly. Alternatively, the reconfigured spatial grid can be selected so that when a document is copied on a conventional copying device or scanned on a conventional scanner, the copied or scanned image contains image artifacts, for example moiré patterns, associated with mismatches in the pixel grid patterns of the document and the copier or scanner. For example, reconfiguring a printer during printing from a pixel density in the direction perpendicular to the receiver path of 1200 pixels per inch over the entire printhead length to a pixel density in the direction perpendicular to the receiver path of 1199 pixels per inch over the entire printhead length would produce document changes that, while potentially invisible to human observers, would imbue a subtle security signature to the print that would be exceedingly difficult to forge or reproduce but which would easily be detected by machine scanning. The reconfiguration required for this purpose would best be served by very small changes in the pixel density in the direction perpendicular to the receiver path, for example changes of 1% or less, in order that the resulting printed image would be indistinguishable to the human eye in comparison with the original pixel density in the direction perpendicular to the receiver path. Reconfiguring a printer during printing from a pixel density in the direction perpendicular to the receiver path of 600 pixels per inch over the entire printhead length to a pixel density in the direction perpendicular to the receiver path of 400 pixels per inch over the entire printhead length would produce a document with pattern artifacts visible to human observers in portions of the document, depending on image content, when copied or scanned with conventional opto-electronic copiers or scanners, which do not attempt to analyze and hide such "incommensurate grid" artifacts.

The opportunity to reconfigure the effective printed dpi in a manner nearly undetectable to the human eye can also be exploited to compensate distortions of the receiver, for example distortions due to fluid absorption, well known to cause the receiver to stretch. If the trigger signals previously discussed are responsive to changes in moisture content (known to image processing unit 24 and image memory 24*a* because the moisture content can be predicted from image content) then by altering the receiver pixel grid, and printing on a stretched substrate, a print can be made which, when dried, will again assume a density of printed pixels representative of the image intended to have been printed assuming no stretching of the receiver. The dimensional changes in receiver stock due to wetting are small; hence this purpose would best be served by very small changes in the pixel density in the direction perpendicular to the receiver path, for example changes of 1% or less.

In another example embodiment of the invention, finely tailored drop steering is used in the steering direction along the receiver path to improve printer reliability and reduce manufacturing costs. The technique can be understood from FIG. 4*a* and FIG. 3. FIG. 3 shows the trajectory of drops 66 which land on front face 90 of catcher 42. FIG. 4*a* shows catch sensor 222 in bidirectional communication via external data interconnect 202 with mechanism control circuits 26. Catch sensor 222 may be any type of physical sensor, for example an optical sensor such as a CMOS camera sensor or an electrostatic sensor, capable of detecting the impact location of drops on the catcher front face 90, as is well known in the art. It is assumed that a document, whose image data is contained in image source 22, is being printed by continuous printer system 20, the document having started printing at a particular print time 'pt0.' Sensor 222 monitors the landing locations of drops which are not printed but which land on the surface of the catcher. Ideally, all caught drops should land on the catcher at the same distance from their associated nozzle 50, thus forming an ideal landing line or catch line of drops on the catcher (out of the plane of FIG. 3). Sensor 222 is capable of recording the positions of any drops landing at an excessive distance from the ideal catch line, for example, landing position data on drops which land closer to the associated nozzle plate or closer to the receiver than a predetermined tolerance printing. Microcontroller 38 in conjunction with sensor 222, with which it communicates via bidirectional external data interconnects 202, and based an assessment of data from sensor 222, would send a trigger signal 230 to mechanism control circuits. Trigger signal 230 according to this example embodiment would include data specifying the positions of drops from any jets landing at an excessive distance from the ideal catch line as determined by sensor 222. In response to this trigger signal, the reconfiguration data memory elements 210 are reprogrammed with instructions or rewritten with steering parameter data used by the jet control circuit 29 to execute finely tailored drop steering of subsequent drops. In this case, the steering would improve the landing location of drops not printed on the catcher, in the sense that they would land closer to the ideal catch line. Because these instructions or steering parameter data are written into memory elements, all subsequent drop catching would remain modified so that subsequent caught drops would fall closely to the ideal catch line. Microcontroller 38 is programmed to periodically execute the sequence described above during document printing at times pt1, pt2, pt3, etc. (greater than pt0) these times preferably occurring between the printing of pages, in order to allow for bidirectional data transfer without interruption of document printing. Finely tailored drop steering thus improves the consistency of drop catching, known in the art of continuous ink jet printing to benefit system reliability. In particular, for catchers having poor dimensional tolerances, for example due to manufacturing errors, improvements in consistency of drop catching benefit system reliability and enable less expensive manufacturing tolerancing.

In another example embodiment of the invention, a combination of finely tailored drop steering in the steering direction along the receiver path in combination with finely tailored drop steering in the steering direction perpendicular to the receiver path is used to improve image quality and reliability and to enable secure document printing. It is assumed that a document 200, whose image data is contained in image source 22, is being printed by continuous printer system 20, the document having started printing at a particular print time pt0. According to this embodiment of the present invention, at a print time pt1>pt0, a reconfiguration trigger signal 230, initiated for example from sensor 220, triggers the process of unobservable reconfiguration of the receiver grid, as in the first example embodiment. However, additionally sensor 222 monitors the landing locations of drops which are not printed but which land on the surface of the front face 90 of catcher 42. As in the second example embodiment, data related to the data from sensor 222 can be written into reconfiguration data memory elements 210 in addition to data related to the reconfiguration of the pixel grid perpendicular to the receiver path. In this case, more data must be written to the reconfiguration data memory elements 210, necessitating larger reconfiguration data memory elements 210. Since microprocessor 38 communicates with image process unit 24, information is available as to the desired locations of drops landing on the receiver grid and landing on the catcher compared to their actual landing locations. Thus microcontroller 38 can compare the actual and desired landing locations of all drops and calculate the amount of finely tailored drop steering in both the directions perpendicular and parallel to the receiver path. The ability to measure all deviations of actual drop landings from their desired landing sites is a powerful feedback tool in the practice of the current invention. According to the third example embodiment, the microcontroller, at predetermined intervals, preferably after each printed page, can continue to compare the actual and ideal landing sites of all drops and send trigger signals 230 to reprogram reconfiguration data memory elements 210 for finely tailored drop steering in either steering direction. Since the drops move through air and thereby interact, the corrections in both directions affect one another; hence, microcontroller 38 can serve to optimize drop positioning on the receiver and drop position on the catcher.

A printer system that includes the present invention has advantages when compared to conventional printing systems. For example, a printer system including the present invention can use finely tailored drop steering having steering components in a direction perpendicular to the receiver path to reduce repetitive errors in printing. Repetitive errors can occur in printing for many reasons, for example a single nozzle can fail. Repetitive errors in single pass printing are highly visible to the eye. They may be corrected by having a second line of printheads which can substitute for a failed nozzle in the first set, but his increases system cost and complexity. Repetitive errors can be corrected in accordance with the present invention in a way nearly invisible to human observes. This embodiment of the present invention relies on the fact that changing the effective receiver pixel grid dpi from a large value, for example 1200 dpi, to a very slightly smaller value, for example 1199 dpi, can be accomplished in a way not easily perceived by human observers, as discussed. Specifically, if one nozzle fails or becomes persistently misdirected, a remedy to the subsequently poor image quality can be found in a modification of the first example embodiment. For example, upon determination, either by a human printing manager 224 or by print sensor 220 observing printed images, that a nozzle has become substantially defective, a process identical to that described in the first example embodiment, but in which the known defective nozzle is selected for deactivation, can be used to improve image quality. A trigger signal 230 is created, for example from print sensor 220 or from print manage interface, interfacing for example with a human printing manager, and is delayed by microcontroller until the next document page has completed printing. Thereafter, the trigger signal 230 is sent to reconfigure the receiver dpi through reprogramming reconfiguration data memory elements 210 and deactivation memory elements 208 with the added data that one of the nozzles selected for deactivation is the substantially defective nozzle. In this case, of course, it is not possible to subsequently return the printer to the original receiver grid resolution. This technique breaks the one to one correspondence between the density of the pixel grid in the direction perpendicular to the receiver path and the native nozzle density. A continuous grading of the amount of drop steering between consecutive adjacent drops as here practiced is advantageous in improving repetitive defects without the need for expensive redundancy.

A printer system that includes the present invention has other advantages when compared to conventional printing systems. For example, a printer system including the present invention provides can use finely tailored drop steering having steering in a direction perpendicular to the receiver path to 'unobservably' reconfigure, during printing, the receiver pixel grid in the direction perpendicular to the receiver path but the reconfigured grid extends over only a portion of the width of the receiver. Such reconfiguration is referred to as local reconfiguration and is intended to reconfigure the pixel grid over a macroscopic distance, for example an inch, rather than a small distance, for example less than or equal to a millimeter, so that the human eye is not sensitive to the change in pixel grid density as is well known in the art of image processing. For example, the reconfigured grid might extend over only one four inch nozzle plate of the print module. Specifically, if each nozzle plate and associated array of nozzles were 4 inches long in the direction along the nozzle array and the print module comprised 6 nozzle plates for printing on a receiver 24 inches wide, then in accordance with this example embodiment, only a portion (here one) of the six nozzle plates might be reconfigured, hence the terminology local or macroscopic reconfiguration is used. By way of example, such reconfiguration might be user-selected to occur for a particular page (paragraph) of the document being printed, thus the printed document would have a reconfigured pixel grid over part of one page along the page width. Advantageously in this embodiment, distortions of the receiver caused by stretching can be compensated in cases where the distortion did not extend over the entire width of the page, for example because only part of the page width was printed heavily with ink. Such "wet load" distortions are well known to be predictable because moisture content anywhere on a page can be predicted from the image content and a knowledge of paper type. By altering the receiver pixel grid locally when printing on a locally stretched substrate, a print is made which, when dried, will again assume a density of printed pixels more representative of the image intended to be printed. In the case of local reconfiguration, there can be an abrupt transition across the width of the printed page in the receiver pixel grid density perpendicular the receiver path. Depending on image content, such an abrupt transition might reduce image quality. If so, then near the ends of the reconfigured nozzle plate, the finely tailored steering could be adjusted so that the spatial density gradually changes from its reconfigured value, for example 1199 pixels per inch, to its original value, for example, 1200 pixels per inch, over the course of a few nozzles. Such stitching techniques are well known in the art and are advantageously supported by the current invention.

There are other advantages for a printer system that includes the present invention when compared to conventional printing systems. For example, a printer system including the present invention can use finely tailored drop steering and finely tailored drop steering memory elements to provide corrective steering on a page to page basis during printing to compensate for gradually changing nozzle ejection characteristics, such as nozzle changes arising for example from wear. A one to one correspondence between the positions of the printed drops and the native nozzle density is preserved. The use of finely tailored drop steering memory elements on the nozzle plate reduces the data transfer rate otherwise needed between image memory 24*a* and jet control circuit 29.

Example embodiments of hardware enabling the practice of the receiver pixel grid reconfiguration techniques described above will now be discussed. The design of jet control elements, memory elements, and sensors to cooperatively support these methods advantageously improves the efficiency and cost associated with its implementation.

As noted, in accordance with the present invention, the printer comprises one or more jetting modules, each having a nozzle plate that includes at least one nozzle. The at least one nozzle having an associated jet control element 51*a* capable of forming drops from the continuous jet (stream) of ink and capable of providing finely tailored drop steering to modulate or alter the trajectory of drops or of the individual streams in an arbitrary direction with components either parallel or perpendicular to the paper path or both. in response to energy pulses provided by a jet control circuit 29. The jet control circuit including reconfiguration data memory elements 210 to store data related to the level of finely tailored drop steering to be applied. There are many known mechanisms by which these functions can be performed, and the types of drops formed, the reliability of drop catching achieved, and the amount and precision of drop steering all depend on the jet control elements and their activation timing. The mechanism providing finely tailored drop steering for each jet is referred to as a jet control element. There are many types of jet control elements, for example jet control elements include well known devices based on electrostatic attraction of the jet or of the drops formed from the jet by electric fields induced by applied voltages or by image charges, electrostatic repulsion of the jet or of the drops formed from the jet from high frequency electric fields induced by applied voltages for low conductivity liquid jets, electro-hydrodynamic perturbations of the exiting jet or drops formed from the jet, mechanical perturbations of the jet or the drops formed from the jet including mechanical perturbations of the moving fluid below the top of the exit point of the jet or drops from the nozzle plate, magnetic attraction or repulsion of the jet or drops for liquid jets which respond to magnetic fields such as liquids containing magnetic particles, and heat induced thermal steering. The examples of the example embodiments are here discussed in terms of thermal steering, but all steering mechanisms which can modulate the trajectory of the drops or of the individual jets in an arbitrary direction with components either parallel or perpendicular to the paper path or both are within the scope of the invention.

For example, in the case of drop formation, a heater surrounding each nozzle, an electrode for electrohydrodynamic stimulation, or a piezoelectric actuator can, when selectively activated, perturb the associated filament of liquid 52 to induce portions of the filament to break off from the filament body and coalesce to form drops 54, 56. In the case of drop catching, the liquid drops are caused to deflect such that some of the liquid drops contact the catcher 42 while other drops are allowed to contact the receiver 32. Typically, drop deflection is either electrostatic, mechanical, gas flow, or thermal steering or a combination. In the case of a gas flow deflection mechanism, the drops to be guttered and the drops to be printed are formed to have different volumes and are hence deflected differently as they subsequently travel through a region of flowing gas. In the case of a thermal deflection mechanism, heat is asymmetrically applied to liquid 52 that forms the jet using a drop control heater element 51*b*. When used in this capacity, drop control heater element 51*b* can operate as a drop forming mechanism in addition to a catch-deflection mechanism. This type of combined drop formation and catch-deflection has been described, for example, in U.S. Pat. No. 6,079,821. Conversely, separation of a thermal drop forming mechanism and thermal drop-catch mechanism has also been disclosed. Catching has also been disclosed using an electrostatic deflection mechanism. Typically, the electrostatic deflection mechanism either incorporates drop charging and drop deflection in a single electrode, like the one described in U.S. Pat. No. 4,636,808, or includes separate drop charging and drop deflection electrodes.

In the case of finely tailored drop steering, the steering mechanism may be of any type capable of very small and reproducible changes in drop trajectories in all spatial directions, for reasons to be discussed. Candidate technologies include, but are not limited to, thermal, electrostatic, mechanical, and gas flow, which cause a selected drop to follow an altered trajectory so that the drop lands in an altered location, either on the receiver or on the catcher, depending on whether the drop is to be printed or caught. The finely tailored steering mechanism can also be a combination of these or any other steering elements. It is possible for all three functionalities to be incorporated in one mechanism, for example in a jet control mechanism that is capable of forming drops, steering them into a catcher, and providing finely tailored drop steering in all spatial directions.

Generally, in the current description of the example embodiments of the present invention, drop formation is assumed to be accomplished by a jet control element, finely tailored drop steering by the same jet control element, and drop catching by a gas flow mechanism which deflects drops depending on their size, the drop size being determined by the same jet control element. In this embodiment, the jet control element must rapidly form drops of arbitrarily selected sizes at rates (typically up to 1 MHz) at least near the maximum pixel print rate, as must the drop-catch mechanism. However, advantageously in this embodiment, finely tailored drop steering can remain the same for substantial times, and therefore need be changed only at a substantially slower rate (typically <0.01-100 Hz). In other words, finely tailored drop steering repositions the landing spots of the drops, either on the receiver grid or on the catcher, only after a very substantial number of drops have been formed and printed.

Many jet control elements have been studied which accomplish these objectives. For example, U.S. Pat. No. 6,079,821 describes drop formation and steering in the direction of the paper path. U.S. Pat. No. 6,517,197 describes drop formation and steering in the direction perpendicular to the paper path. U.S. Pat. No. 6,213,595 describes steering which could be controlled in any direction as a result of superposing steering in the directions perpendicular to and along with the paper path. U.S. Pat. No. 7,735,981 describes the manufacture of heater elements comprised of several independent asymmetric heaters and designs of multiple segmented heaters located around portions of the each nozzle powered at different levels. As the heater configurations described in U.S. Pat. No. 6,517,197; U.S. Pat. No. 6,213,595; and U.S. Pat. No. 7,735,981 demonstrate steering in both the direction perpendicular to the paper path and parallel to the paper path, these devices are suitable for use when practicing the present invention.

Figure 4E:
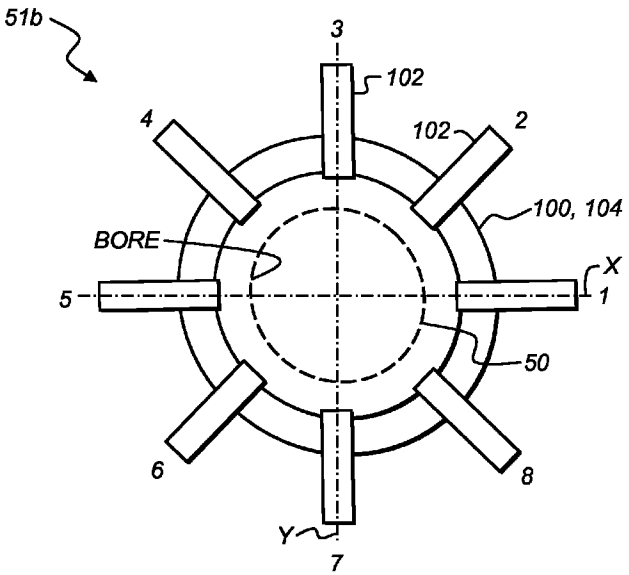
FIG. 4*e* is a schematic view of an example of a surrounding heater jet control element having sufficient steering contacts.
Figure 5:
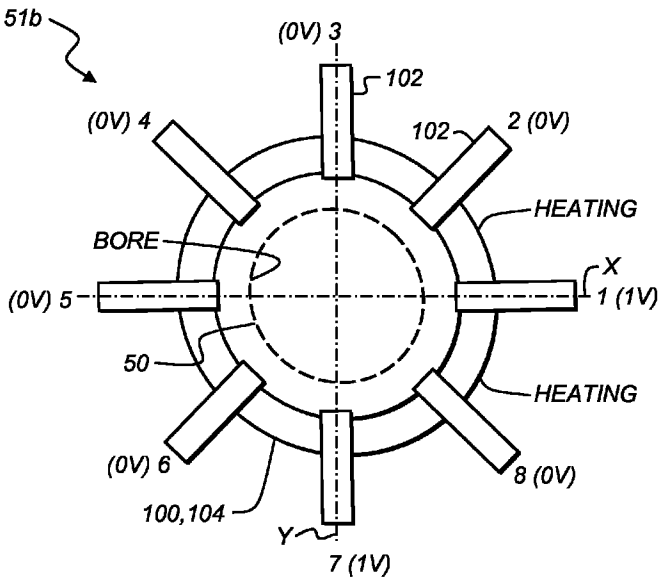
FIG. 5 is a schematic view of an example of a surrounding heater jet control element having sufficient steering contacts.
Figure 6:
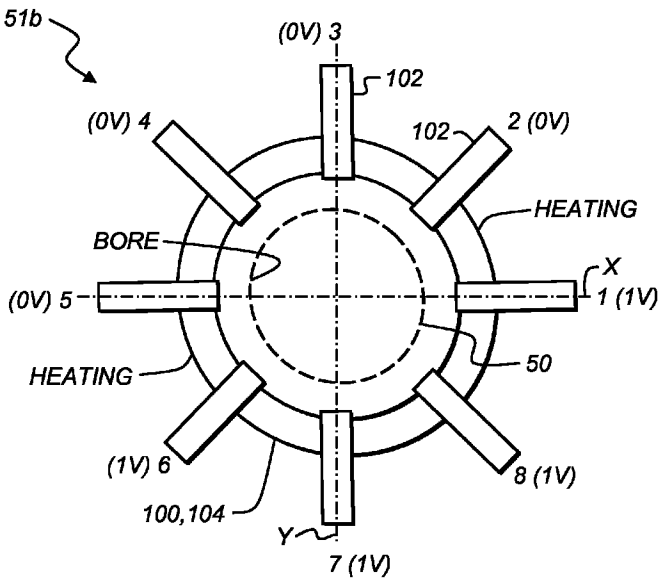
FIG. 6 is a schematic view of an example of a surrounding heater jet control element having sufficient steering contacts.

For the purpose of the current discussion, a jet control element is described which comprises a heater made of an electrically resistive material which continuously surrounds the associated nozzle and is contacted by a sufficient number of electrical contacts. The voltage on each of the electrical contacts can be controlled to steer drops or jets in an arbitrary direction. Having a sufficient number of electrical contacts means having a number of electrical contacts sufficient to provide steering in an arbitrary direction. The continuously surrounding heater element 51*b* shown in FIGS. 4*e*, 5 and 6 is particularly effective for the use of finely tailored drop steering to reconfigure the spatial nozzle density in the direction perpendicular to the receiver path because it provides heat without the high electric fields associated with discontinuous heater segments. However, this choice of heater should not be construed to limit the present invention from the use of other jet control elements to provide the combination of drop formation, catching, and finely tailored steering. It is also a feature of the present invention that the continuously surrounding drop control heater element has the same number of electrical contacts as independently controllable portions whose heating can be controlled by application of voltages to the electrical contacts, at a position removed from the junction of the electrical contact and the resistive material. This facilitates manufacturing by reducing the number of electrical contacts that would otherwise be required, for example required by the use of multiple independent heater segments, each contacted electrically at each of its ends. It should be noted that the term "continuously surrounding" in reference to the heater material 100 of drop control heater element 51*b* includes cases where the properties of the heater material are altered, for example by contact ion implantation, in the immediate vicinity of the electrical contact. For example, if the electrical contact 102 spans a region of the resistive material 100 in the direction of the surrounding drop control heater element and the resistive material is altered or even broken in this contact region, the drop control heater element is still a continuously surrounding element because the electrical contact to both sides of the material in the material-altered or material-broken region causes the voltages of those regions to be identical, as is well known in the art of electrical contact engineering.

FIG. 4*e* shows a top view of a continuously surrounding drop control heater element 51*b* in the form of an annulus made of a resistive material 100, typically deposited by the deposition techniques of silicon circuit technology, having sufficient electrical contacts 102 such that drop control heater element 51*b* is capable of forming drops, including drops of various sizes, velocities, etc, in accordance with known art, and of providing finely tailored drop steering, that is drop steering which modifies the trajectory otherwise taken by a drop in finely differentiated directions and amounts, as is required for its function in the example embodiments. A sufficient number of electrical contacts means a number of electrical contacts sufficient to allow control of drop steering or jet steering in an arbitrary direction in the plane of the nozzle plate. The continuously surrounding drop control heater elements 51*b* are contacted by electrical contacts 102 in FIGS. 4*a*, 5, and 6 which are highly electrically conductive. In this example, there are eight electrical contacts 102, contacting the resistive material 100 to define eight heater element portions 104, the first portion being that portion between the first and second electrical contacts, the second portion being that portion between the second and third electrical contacts, etc. In accordance with digital operation of continuously surrounding heater element 51*b*, as shown in FIGS. 5 and 6, each evenly spaced electrical contact 102 is 'clocked' between two voltage states shown as high (1 volt) and low (0 volts). The voltage applied to the electrical contacts is intended to be applied by a voltage source in electrical communication with the electrical contact 102 at a point removed from the region of contact (junction) with the resistive material 100. If no voltage source is applied to the electrical contact 102 in question, for example if a switch between the voltage source and that electrical contact is 'open,' then the voltage of the electrical contact in question is determined by the voltages of the electrical contacts next to that contact, as is well known in the electrical engineering art. These voltage states can alternate rapidly in time in response to digital data from jet control circuit 29, deactivation memory elements 208, reconfiguration data memory elements 210, or compressed reconfiguration data elements 212 of FIG. 4*a*. Generally a low state is denoted as zero volts; a high state can be between 1 and 100 volts.

The electrical status of the continuously surrounding drop control heater element 51*b* at a particular time is specified by an eight bit binary code at various times one bit for each of the eight electrical contacts, for example {01010101}, at a time t1; {01111111}, at a time t2; {01111000} at a time t3; and {01110000} at a time t4. Accordingly, since the resistive heat produced by a voltage drop between two electrical contacts is dependent on the square of that voltage drop, assuming the electrical resistance of the material 100 between electrical contacts is constant, the heat distributions produced in the portions 104 can be represented by the expression [11111111] at time t1, [10000001] at time t2, [10001000] at time t3, [10010000] at time t4, as can be appreciated by one skilled in electrical engineering, where 0 represents no heat produced and 1 represents the maximum heat production in any portion 104 of heater element 51*b* between contiguous electrical contacts. The first number in the [brackets] represents one of two digital levels of power input to a portion of heater element 51*b* between electrical contacts 1 and 2, the second number represents the power input to the heater segment between electrical contacts 2 and 3, etc., with the last number in the brackets represents the power input to the heater segment between contacts 8 and 1. FIG. 5 illustrates an electrical status to the electrical contacts 102 corresponding to (10000000) to yield a heat distribution [10000001]. Heat is applied symmetrically about the X axis (horizontal axis), so there is no deflection of the drop steam in the Y direction (vertical axis). The heat being concentrated around the positive X axis, does cause the jet to be steered, typically in the negative X direction FIG. 6 illustrates an electrical status to the electrical contacts 102 corresponding to {10000111} to produce a heat distribution [10001000] This heating pattern produces no deflection of the drop stream.

To a good approximation, the heat induced steering produced by a given configuration of electrical contact voltages between each sequential pair of electrical contacts, here denoted delta_X and delta_Y (in the directions x, perpendicular to the path of the receiver, and y, parallel to the path of the receiver) is given by a vectorial average of the angular asymmetry of heat around jet control element 51*b*. The total amount of heat produced along any heater element portion 104 of the drop control heater element 51*b* depends on the square of the voltage difference between the contacts and on the time of application of the voltage as well as on the geometry and materials properties of the nozzle, as is well known in thermal and electrical engineering. Here, we approximate that the heat transferred to the liquid 52 of the jets is proportional to the square of the voltage difference between the contacts. In accordance with this approximation in FIGS. 5 and 6, delta_X=−[s]·*cos [1*360/16, 3*360/16, 5*360/16, 7*360/16 . . . 15*360/16] and delta_Y=−[s]·*sin [1*360/16, 3*360/16, 5*360/16, 7*360/16 . . . 15*360/16], where the numbers in the brackets indicate the elements of a vector, the vector multiplication symbol ·* is an element by element multiplication, and the cos and sin operations are element by element, a notation well known in many mathematical modeling software routines, for example MatLab® from Mathworks®. Specific example calculations for the steering are given below for different heat distributions denoted by [s]: For [s]=[10000001], as illustrated in FIG. 5, the deflection is in the x direction only and is −2*cos(360/16). For [s]=[11111111] and for [s]=[10001000], as illustrated in FIG. 6, the deflections are zero, since there is no heat asymmetry. For [s]=[00000000], the deflection is zero since there is no heat applied. For [s]=[10010000], the deflection is only in the Y direction and is −2*sin(360/16); whereas for [s]=[11110000] corresponding to the binary code {01010000} the deflection is in the y direction and is −2*sin(360/16)−2*sin(3*360/16), corresponding to the maximum asymmetry possible and hence the maximum deflection magnitude possible. For [s]=[10000100] corresponding to the binary code {01111100} for voltages on the contacts 102 the deflection in the y direction is −sin(360/16)+cos(360/16), corresponding to the minimum non-zero deflection magnitude possible, and the deflection in the x direction is of the same magnitude but opposite sign. For [s]=[00100001], corresponding to the binary code {00011111}, the deflection in the x and y directions are −cos(360/16)+sin(360/16). The formulas above assume that the liquid jet 52 deflects away from heat, as is the case for most fluids. It is know, however, that for some fluids, the jet deflects toward heat because of the dependence of liquid parameters such as surface tension and viscosity on temperature. It is important to note that not all heat configurations s are allowed for voltages limited to either one or zero on electrical contacts 102. For example s=[01001001] is not an allowed distribution for the examples of eight contacts discussed here.

Although these formulas are simplistic, they are approximately correct since heat flow constitutes a linear system. The formulas are intended only as approximate guides to help explain the current invention and to help establish working tables relating the voltages applied to the contact leads 102 to the experimentally observed values of deflection. In practice such experimentally derived tables are often preferred to approximate calculations. Alternatively, accurate computational models can be used to predict steering corresponding to the voltage distributions of the electrical contacts.

Figure 7:
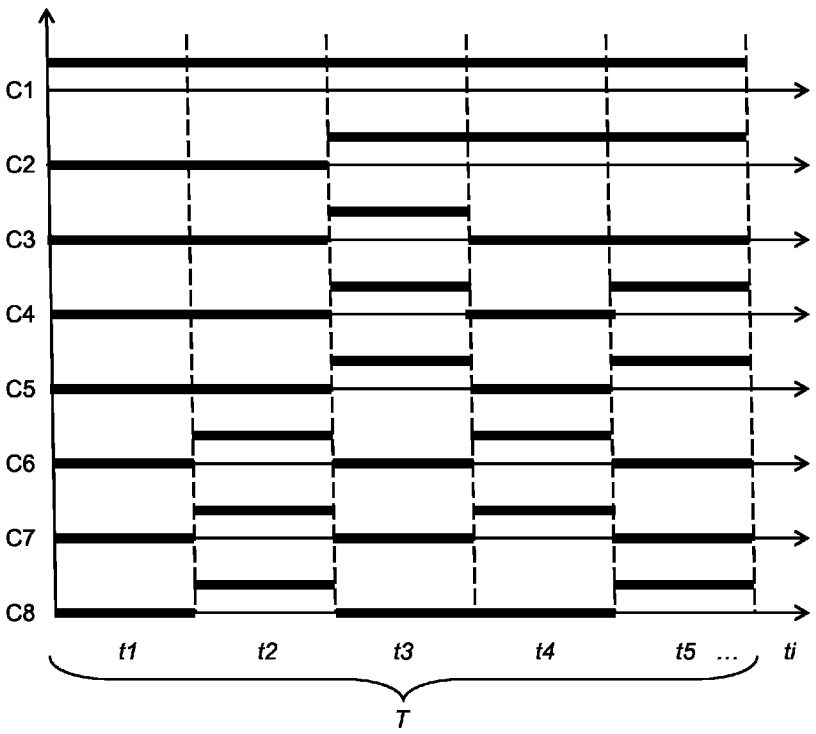
FIG. 7 is a schematic view of an example of electrical waveforms applied to the surrounding heater jet control elements of FIG. 4*e;*

Further in accordance with the preferred embodiments, as shown in FIG. 7, the configuration of voltages on the electrical contacts 102 can be changed very rapidly in time, with the result that the deflection is averaged over many such configurations or pulses, the averaging time being characterized by the thermal response time T of the jet control element 51*a*. FIG. 7 shows the voltages configurations on the electrical contacts of the device of FIG. 4*e*, at time intervals t1, t2, and t3, etc. The time intervals are chosen to be much smaller than the thermal response time T. Typically, the pattern of voltages, shown in FIG. 7 as a pattern of five time intervals, is repeated several times within the response time T, so that deflection is very well averaged over T. In this case, the individual time intervals t1, t2, t3 etc. in FIG. 7 are advantageously also less than the minimum formation time between two drops. Typical thermal response times of the continuously surrounding drop heater elements 51*b* are on the order of ten microseconds. The minimum formation time between two drops is typically chosen to exceed the thermal response time of the continuously surrounding drop control heater element 51*b* in order that the ink jet experience temperature pulses that are not reduced in influence by averaging over time. In the case that the configuration of voltages on the electrical contacts 102 is changed very rapidly, the net drop deflection amounts delta_X and delta_Y must be calculated by averaging the deflections for each of the voltage pulse configurations as discussed previously to establish the total finely tailored drop steering in the directions perpendicular (X) and parallel (Y) to the path of the receiver. Again, although the averaging formula is simplistic, it is useful since heat flows in solids generally comprise linear systems. The averaging concept intended as a guide to help establish working relationships relating the time averages of the binary codes for voltages applied to the contact leads 102 to the experimentally observed total values of deflection. In practice, the actual time averaged deflection is measured and a table constructed relating the actual deflections to the patterns of voltages applied to the electrical contacts 102.

As an example of time averaging, we may consider the case of only two pulses, repeated very rapidly many times during the time interval T. If the configuration of voltages on the electrical contacts 102 for these two pulses is [s]=[10000100] and [s]=[10001000], then the average deflection in the y direction is proportional to (−sin(360/16)+cos(360/16)−sin(360/16)+sin(360/16))/2 and the average deflection in the x direction is proportional to (−cos(360/16)+sin(360/16)−cos(360/16)+cos(360/16))/2, where the division by two accounts for the reduced time of application of the two pulse types. If there were N pulse types of the form [s]=[10001000] (no deflection) and M pulse types of the form [s]=[10000100] (minimal deflection) during the time T, then the averaged deflection would be M/(N+M) compared to the case of only a single pulse of type [s]=[10000100], thereby allowing for a very small amount of deflection for N>>M. Similarly, many combinations of pulse sequences are possible, enabling finely tailored drop steering over a range which causes a selected drop to follow an altered trajectory catcher, depending on whether the drop is to be printed or caught.

A wide range of variation of deflections is available, both in angle and magnitude. For example in the case of 100 time intervals, the minimal non-zero deflection magnitude (M=1) directed only in the X direction would be [1*sin(360/16)+1*sin(360/16)], (s=[00100100]), compared to a maximal deflection magnitude directed only in the X direction of [200*cos(360/16)+200*cos(3*360/16)], (s=[00111100]), a ratio of about 500, providing about 500 gradations of deflection. A different ratio R characterizes the largest ratio of the deflection magnitudes in the X and Y directions, which in this example of 100 pulses occurs for 99 pulses of the form s=[100111100] (maximal X) and one pulse of the form s=[10000100] (minimal Y), corresponding to about R=500. The ratio of the largest to smallest deflection magnitudes scales as the number of pulses averaged. This ratio is advantageously chosen so that the printer may be dynamically reconfigured to have a pixel grid density in the direction perpendicular to the paper path that varies only slightly from the density prior to reconfiguration, thus requiring fine gradations of steering from jet to jet. A large number of gradations, for example 300 gradations if a 600 per inch pixel grid is reconfigured to a 599 per inch pixel grid, is required, the magnitude of the largest deflection, near the deactivated nozzle, is determined by the properties of the heater, such as the material resistivity and geometry which determine the heat produced for a voltage drop of one volt across a heater element component. This largest deflection is typically chosen to be about one half of the initial pixel spacing in the direction perpendicular to the receiver path, in accordance with the present invention, as discussed previously. Of course, the maximum deflection can be altered if voltages other than zero or one volt are applied to the electrical contacts 102, although this requires more circuit elements.

If the drop forming mechanism is the same mechanism as the finely controlled drop steering mechanism, then the waveforms for drop formation may be superposed or otherwise combined with those used for finely tailored drop steering since both steering and initiation of drop formation comprise approximately linear systems.

Figure 8:
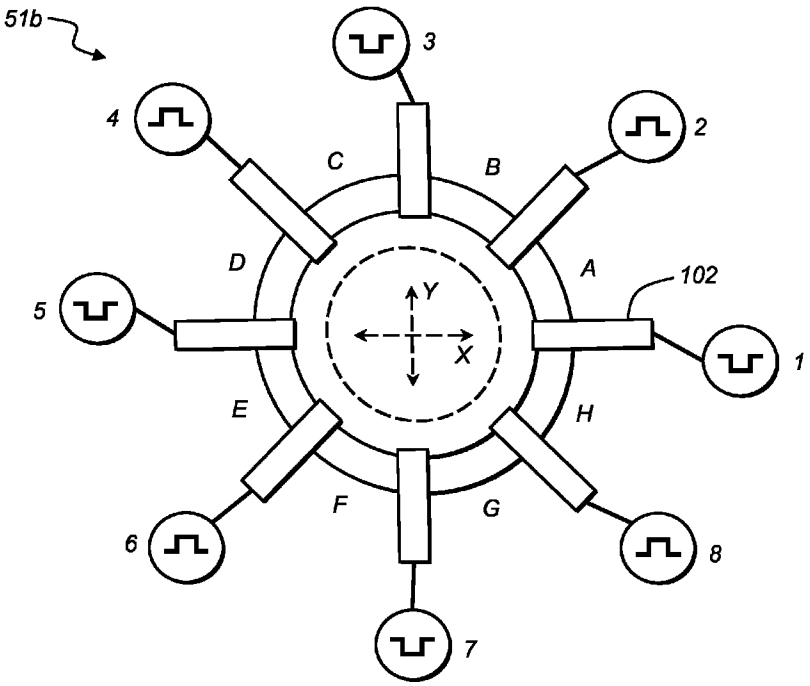
FIG. 8 is a schematic view of an example of a surrounding heater jet control element having sufficient steering contacts and showing the direction of drop deflection.

In another example embodiment of a drop control mechanism, a heater control element continuously surrounds the associated nozzle bore, the continuously surrounding element being particularly capable of very small adjustments in steering, described in FIG. 8. In FIG. 8 a nozzle is shown surrounded by a resistive ring heater. In this particular example, eight electrodes contact the resistive heater at evenly spaced intervals. The electrodes are shown spanning the width of the heater element, so that the current is fairly evenly distributed across the heater. The electrodes can be tapered, as described in US 2005/0179716, to further improve the current distribution in the heater. The electrodes or electrical contacts are shown numbered from 1 to 8 with the heater sections labeled A to H. Also shown in FIG. 8, the even numbered electrodes are switched between zero volts and a fixed positive voltage, in response to the print data; such that all of the even numbered electrodes have the same applied voltage. The odd numbered electrodes are switched between zero volts and a fixed negative voltage, not in response to the print data, but rather in response to the desired steering of the drops. The fixed negative voltage could differ in magnitude from the fixed positive voltage. The duration of the non-zero negative voltage pulses applied to each of the odd numbered electrodes can be adjusted relative to the other odd numbered electrode to yield the desired finely tailored drop steering. In this case, the voltages applied to contacts 102 are shown in FIG. 8 as a function of time for a time period equal to the time required for an image receiver pixel to pass under the print head. When no finely tailored drop steering is desired (here referred to as the base state), the same pulse pattern (which can be a null pattern having no pulses) is applied to each of the odd numbered electrical contacts, and the odd contacts are shown by their values in FIG. 8, the odd contacts having a voltage of zero or a first odd contact voltage, here shown as negative, and the even contacts having a voltage of zero or a first even contact value, here shown as positive.

Figure 9A:
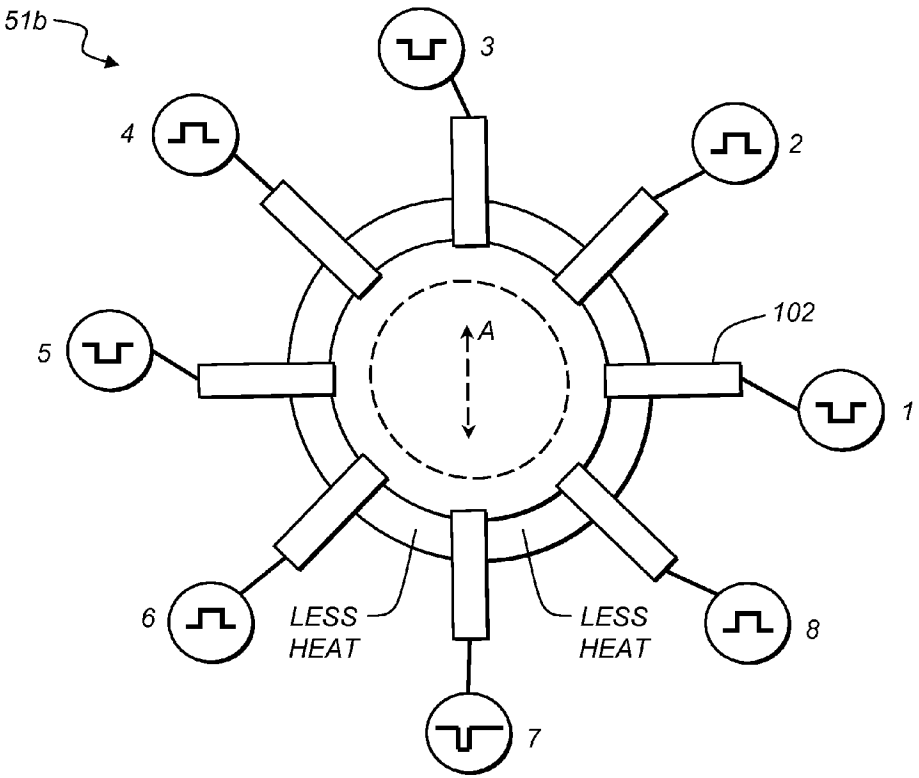
FIGS. 9*a*, 9*b*, 9*c* show schematic views of an example of a surrounding heater jet control element having sufficient steering contacts showing heating of portions and the direction of drop deflection.

To achieve finely tailored drop steering in a particular direction, for example in the direction marked A in FIG. 8 and in FIG. 9*a*, the pulse duration on opposing contacts directed along the A direction is varied as shown in FIG. 9*a*, while the pulses on the other contacts retain their base values. In the case of deflection in the A direction, the duration of the first odd contact voltage of contact 7 is shortened in comparison with the first odd contact voltage of contact 3. In this case of deflection in the A direction, the amount of heat generated is asymmetrical along the A direction and symmetrical along the B direction, as shown in FIG. 9*a* which denotes the heat generated at portions around the continuously surrounding heater as "less heat" to achieve finely tailored drop steering in the A direction.

Figure 9B:
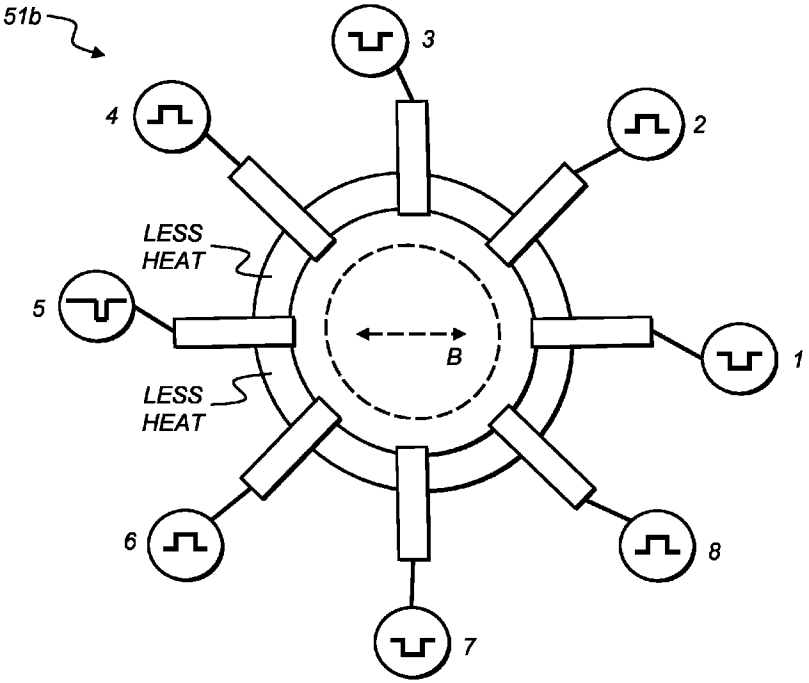

To achieve finely tailored drop steering in the direction marked B as shown in FIG. 9*b*, the pulse duration on opposing contacts directed along the B direction is varied, while the pulses on the other contacts retain their base values. In the case of deflection in the B direction, the duration of the first odd contact voltage of contact 5 is shortened in comparison with the first odd contact voltage of contact 1. In the case of deflection in the B direction, the amount of heat generated is asymmetrical along the B direction and symmetrical along the A direction, (denoted by "less heat" in FIG. 9*b*) to achieve finely tailored drop steering the B direction. This heat distribution typically (but not always, depending on ink type) results in a deflection away from the segment generating more heat in approximate measure to the difference in heat generated between the opposing segments. Also illustrated in FIG. 9*b*, not only is the pulse duration shorter on contact 5, the leading edge of the pulse occurs earlier in time than in the case shown in FIG. 9*a*. Advantageously, the deflection is approximately independent of the timing of the leading edge of the pulse, depending instead primarily on the pulse width, providing the pulse occurs within the time interval of the pulses applied to the even electrodes, because the time-integrated value of the resistive heating voltage drop between contact 5 and neighboring contacts 4 and 6 does not depend on the phase of the pulse on contact 5 provided the pulse occurs within the time interval of the pulses applied to contacts 4 and 6. (For purposes of illustration, the pulses shown on the even contacts in FIG. 8 and on FIGS. 9*a-c* are identical, although this is not required for operation of the current invention.)

Figure 9C:
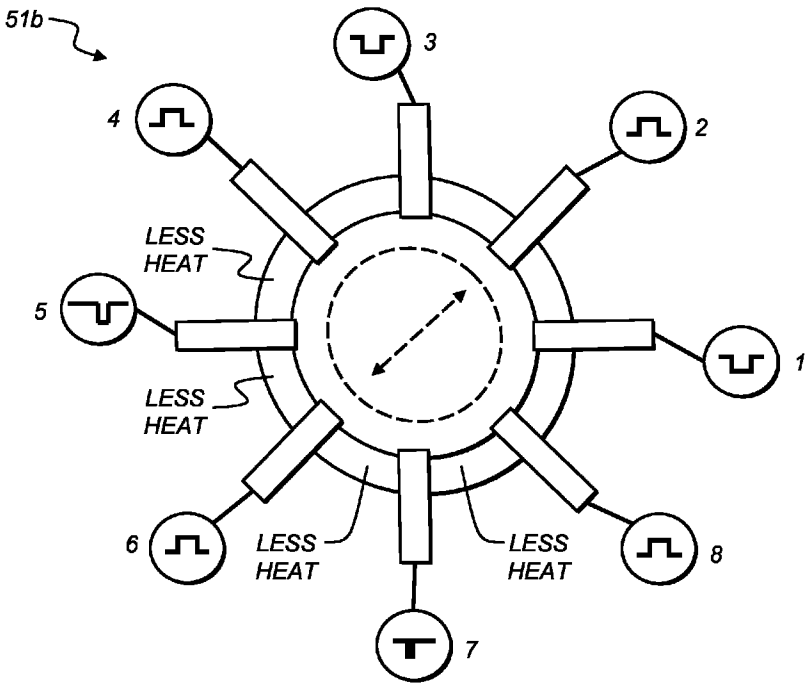

A combination of the waveforms in FIGS. 9*a* and 9*b* results in an approximately vectorial superposition of deflections as shown in FIG. 9*c*, that is in a direction between the A and B direction, as is well known in the art of thermal steering. Again, the heat generated around the continuously surrounding heater to achieve finely tailored drop steering in a direction between the A and B direction is shown in FIG. 9*c* to be asymmetrical (denoted as "less heat"). The direction of steering of the finely tailored drop steering in a direction between the A and B direction shown in FIG. 9*c* is not exactly along the line between contacts 2 and 6 because the duration of the pulse at contact 7 is less than at contact 8 and hence less heat is generated in the portion of the surrounding heater element between contacts 6 to 8 than between contacts 4 to 6.

Assuming the heater contacts are oriented with respect to the receiver path such that the direction A in FIG. 8 is aligned with the receiver path, deflections in the directions perpendicular and parallel to the receiver path are easily achieved, although this heater orientation is not required, since any direction of deflection can be achieved by superposition. This embodiment is simple to implement because every other contact voltage remains the same, and only the duration of the odd contact voltages is changed in duration. As can be appreciated by one skilled in electrical engineering, however, the even contact voltages may be changed in duration as well. In that case, the asymmetry in heat produced must be calculate in approximate accordance to the square of the time averaged voltage difference, as is well known for resistive heating, which allows very fine control over the amounts of deflection and reduces the need for many time intervals.

In yet another example embodiment of a jet control mechanism 28, a heater control element continuously surrounds the associated nozzle bore, the continuously surrounding element being particularly capable of very small adjustments in steering. In this case, the voltages applied to the electrical contacts 102 may be a combination of analog and digital voltage wave forms. For example, the digital portion of the waveform might be applied symmetrically and in the form of high frequency pulses to form drops at the drop formation rate, while the analog voltages might be employed for finely tailored drop steering. The asymmetry in heat produced must be calculated in approximate accordance to the square of the time averaged voltage difference, as is well known for resistive heating, which allows very fine control over the amounts of deflection and reduces the need for many time intervals.

In another embodiment, similarly described by FIG. 8 and FIGS. 9*a-c*, and in the language of the previous embodiment, the odd numbered electrodes are switched on and off at a frequency that is much greater than the drop creation frequency, typically 10-1000 times greater than the drop creation frequency. In this embodiment, the duty cycle of each pulse can still be varied as in the previous embodiment, but only repetitively and at a much faster rate. In this case the switching rate is greater than the thermal response rate of the heater (which is greater than or approximately equal to the drop creation frequency), so that the heaters are each at the same average temperature as in the embodiment in which the even numbered electrodes are switched on and off at a frequency about the same as the drop creation frequency.

Figure 10:
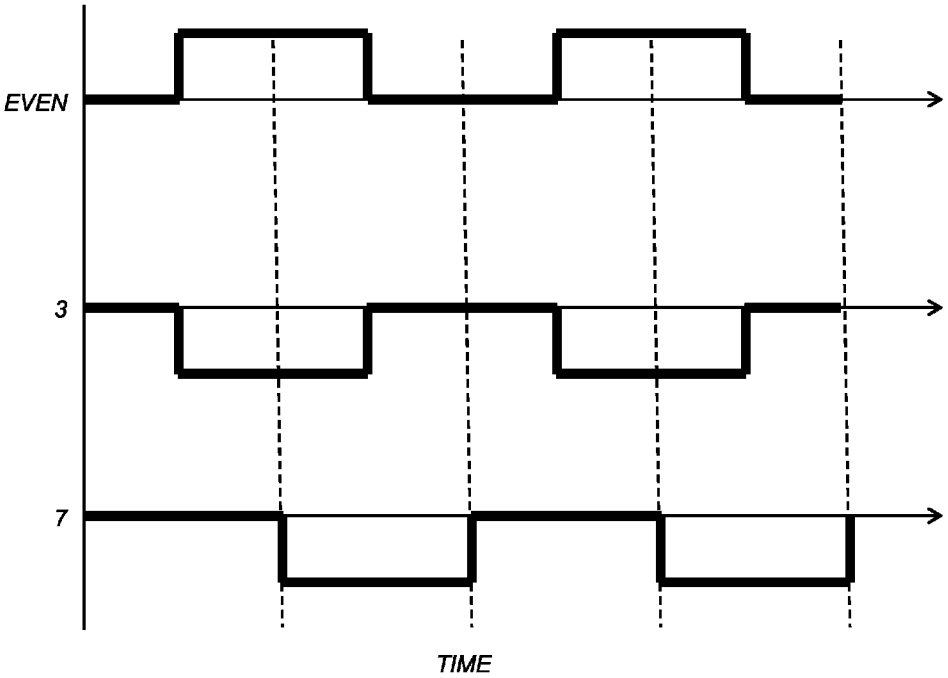
FIG. 10 is a schematic view of an example of electrical waveforms applied to the surrounding heater jet control elements of FIGS. 9*a-c;*
Figure 11:
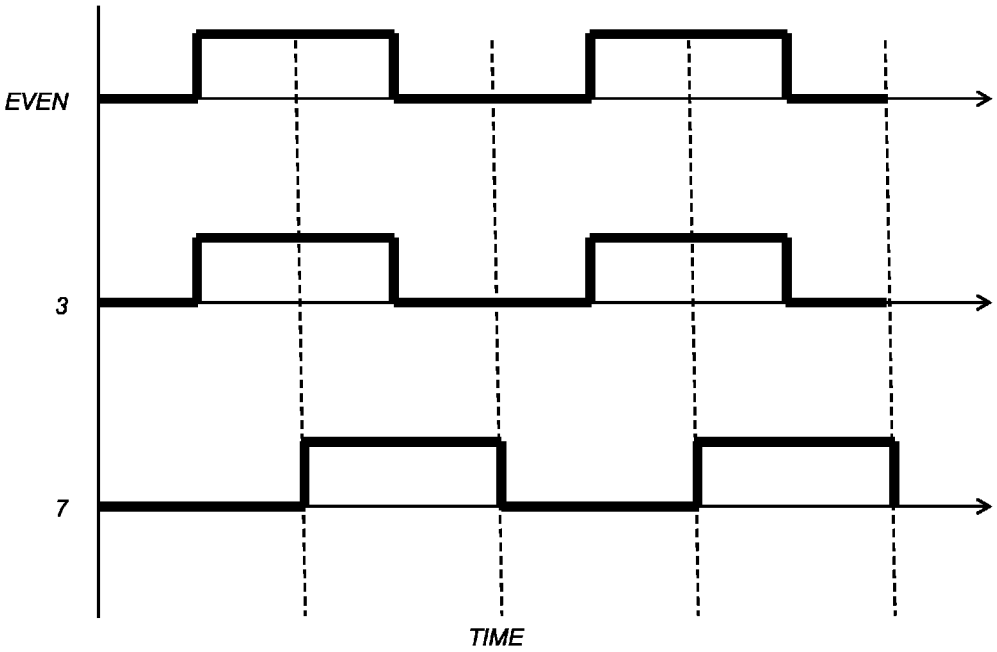
FIG. 11 is a schematic view of an example of electrical waveforms applied to the surrounding heater jet control elements of FIGS. 9*a-c;*

Alternatively, in a variant of the previous embodiment the phase, rather than the duty cycle, of the voltage pulses on the odd electrodes is varied during the course of the pulses over the time interval for drop creation, as shown in FIGS. 10 and 11. An example of finely tailored drop steering using the variation of phase is shown in FIG. 10. In this example, independently varying the phase of the pulses applied to contact 3 and contact 7 relative to pulses applied to the even numbered contacts steers the jet parallel to the arrow A in FIG. 9*a*. In FIG. 10, the magnitudes of the voltage pulses on the even and odd contacts are taken to be +1.0 and −1.0 volts respectively. The negative going pulse to contact 3 is in phase with the positive going pulse to the even number contacts, producing a voltage between electrode 3 and the adjacent contacts 2 and 4 of 2.0 volts for half the waveform period, and 0 volts the rest of the period. The negative going pulse to contact 7 has been shifted 90 degrees relative to the positive going pulses applied to the adjacent even numbered contacts 6 and 8, producing a voltage between contact 7 and the adjacent even number contacts of 2 volts for one fourth of the waveform period, of 1 volt for one half the waveform period, and 0 volts for the remainder of the waveform period. The resulting time averaged heating on the portions of the surrounding heater element adjacent to contact 7 is reduced by 25% relative to the time averaged heating on the portions of the of the surrounding heater element adjacent to contact 3. An alternative example of finely tailored drop steering using the variation of phase is shown in FIG. 11. In this example, the magnitudes of the voltage pulses on the even and the odd contacts are each +1.0 volts, and the voltage pulses to contact 3 are in phase with the pulses to the even numbered contacts. The phase of the pulse to contact 7 has been phase delayed by 90 degrees relative to the other pulses. In FIG. 10, the time averaged heating on the portion of the surrounding heater element adjacent to contact 7 during the time interval for drop creation is increased to 0.5 watts from a value of 0 watts in the absence of a phase delay, assuming a voltage magnitude of 1.0 and a resistance between contacts of 1.0 ohms. Combinations of relative phase variations of two electrodes, for example changes of phase on electrodes 3 and 5, cause deflections in an arbitrary direction due to vectorial addition, as discussed in previous embodiments. Changes of phase are advantageously simple to implement, because for some logic technologies phase change circuitry is easier to design and manufacture than circuitry that changes the pulse duration or than a circuit that changes the pulse amplitude, as can be appreciated by one skilled in circuit engineering. It is understood that although the deflections in the foregoing examples, including the vectorial nature of the additions of deflections in different directions, are approximate representations of the deflections that may occur. In accordance with the current invention, the actual measured amounts for deflections that occur for various configurations of maximum and minimum contact voltages, pulse intervals, and phases would in practice be measured to provide more accurate results, which could be stored in look-up tables, in case the approximate analytic expressions for deflection due to heat asymmetry were insufficiently accurate for the highest image quality printing.

It should be noted that in the geometry shown in FIGS. 8 and 9, the contacts 102 are defined by rectangular strips, typically of a good conductor, shown overlapping the surrounding heater element 51*b*. In FIGS. 4, 5, and 6 contacts 102 are defined by rectangular strips, typically of a good conductor, covering only a portion of the surrounding heater element 51*b*. Such contact variations as well as many others are all contemplated in the current invention. As is well known in the art of semiconductor fabrication, the shape and overlap of a conductor contacting a resistive material and the particular manner in which contact to the material is made is subject to many variations depending on the required current uniformity, contact resistance, heat conduction, etc. for the application, including variations in the resistivity of the resistive material in the vicinity of the contact, typically achieved by ion implantation and activation.

Figure 12:
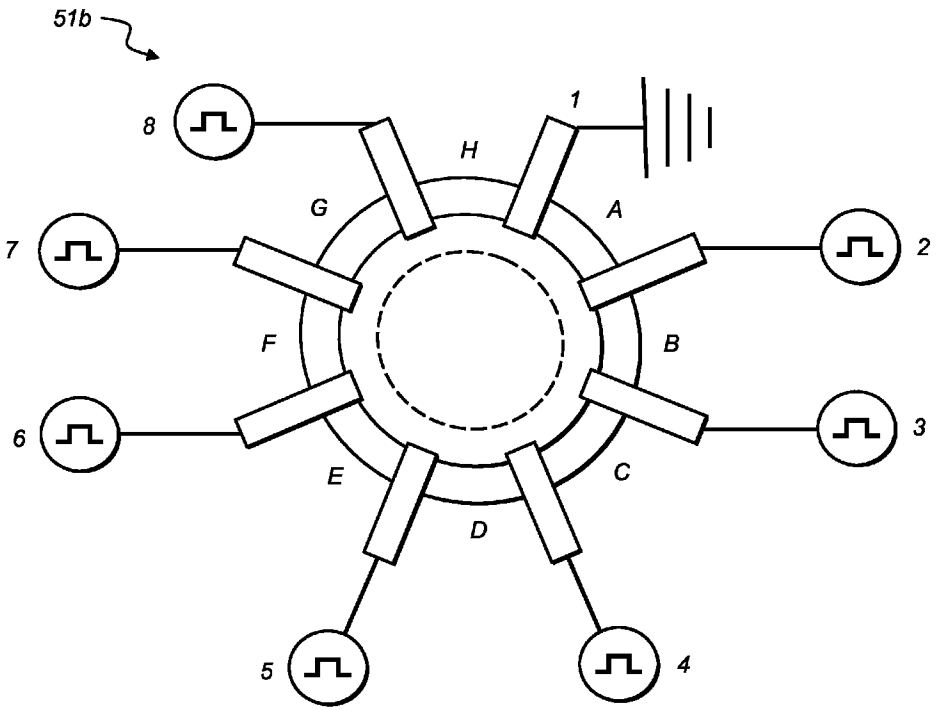
FIG. 12 is a schematic view of an example of a surrounding heater jet control element having sufficient steering contacts and a grounded contact.

In FIG. 12, yet a different drive configuration is shown. Electrode 1 is grounded. All the electrodes 2-8 are switched in response to print data and finely tailored steering needs at a frequency equal to or greater than the print drop formation frequency. By way of example an effectively uniform heating can be provided when electrode 5 is driven with a 30% duty cycle pulse, electrodes 4 and 6 are driven with 22.5% duty cycle pulses, electrodes 3 and 7 with 15% duty cycle, and electrodes 2 and 8 with 7.5% duty cycle pulses. This would result in each heater segment having voltage applied across it for a duty cycle of 7.5% Adjusting the duty cycle of power applied to any heater section relative to the duty cycle of power applied to the heater on the opposite side of the nozzle allows for the steering option in addition to the drop break off control. The asymmetry in heat produced must be calculated in approximate accordance to the square of the time averaged voltage difference, as is well known for resistive heating, which allows very fine control over the amounts of deflection and reduces the need for many time intervals. For example, for each portion of the continuously surrounding drop control heater element 51*b*, for example between contacts 1 and 2, the contribution to finely tailored drop steering in the right, horizontal direction in FIGS. 8 through 12 is approximately proportional to the cosine of the angle midway between contacts 1, as measured from the horizontal axis in FIGS. 8 through 12, multiplied by the time average, over one printing drop time interval, of the square of the voltage difference between contacts 1 and 2. Likewise the contribution to finely tailored drop steering in the upwards, vertical direction is given approximately by the same formula but with the trigonometric function 'cosine' replaced by 'sine,' as can be appreciated by one skilled in electrical engineering. Vectorial addition of the contributions from all the portions of the continuously surrounding drop control heater element 51*b* between all the contacts gives the approximate total steering in the horizontal and vertical directions. In practice, if greater accuracy is desired, the angle and amount of finely tailored drop steering can be measured to provide empirical results, which could be stored, for example, in look-up tables, to achieve the highest image quality printing. The number of electrodes shown in the example embodiments is not restricted to the number eight. For other numbers of contacts, the total vectorial addition of the contributions from all the portions of the continuously surrounding drop control heater element 51*b* between all the contacts still gives the approximate total steering in the horizontal and vertical directions. The proportionality constant between the steering and the squares of the voltage differences may differ, as can be appreciated by one skilled in electrical engineering, depending on many factors, including the resistance of the drop control heater element, the geometry of the nozzle relative to the drop control heater element, and the fluid type.

Figure 13:
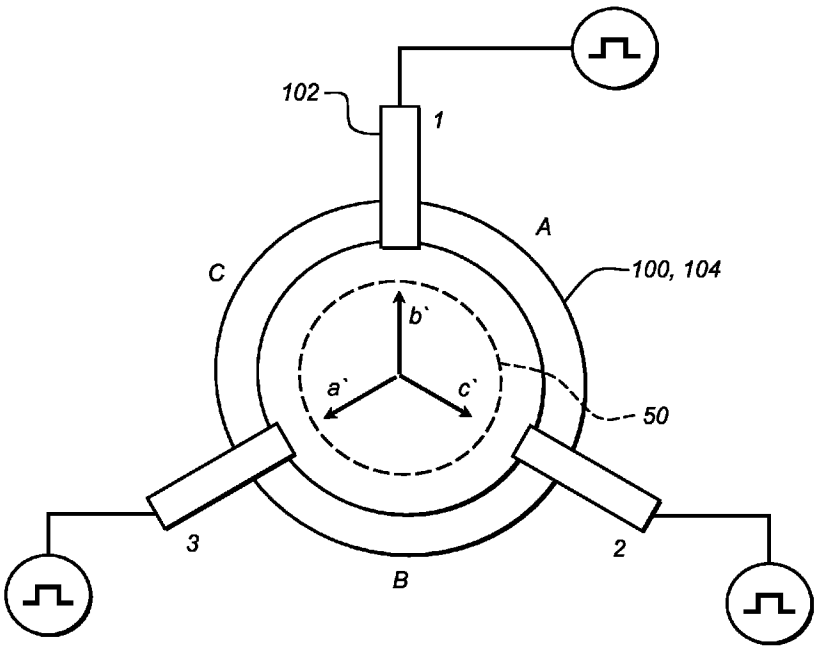
FIG. 13 is a schematic view of an example of a surrounding heater jet control element having three steering contacts for sufficient control of jet deflection steering.

FIG. 13 shows another embodiment of the jet control element in the form of a heater 51*b* surrounding the nozzle 50. The jet control element heater had three electrical contacts 102, which are separately labels 1, 2, and 3. The heater surrounding the nozzle is partitioned by the three electrical contacts into three heater element portions 104; the number of heater element portions 104 equaling the number of electrical contacts 102. The three heater element portions have been labeled A, B, and C. Through the application of appropriate waveforms to each of the electrical contacts, the individual heater element portions can be actuated with sufficient independence, as described below, to enable the jet to be steered in arbitrary directions. As previously mentioned, heat applied by heater portion adjacent to a nozzle typically (but not always, depending on ink type) results in a deflection of the jet flowing from the nozzle away from the heater portion generating the heat. As a result, heat applied by heater portion A causes the jet to be deflected in the direction of arrow a'. Heat applied by heater portion B causes the jet to be deflected in the direction of arrow b' and heater portion C causes the jet to be deflected in the direction of arrow c'. Application of heat to more than one heater portion results in the vector addition of the jet deflections produced by each of the heater portions. As a result if the same amount of heat is applied to each of the heater portions, the jet is undeflected by the heat. By appropriately distributing the applied heat among the three heater portions, the vector addition of the jet deflections produced by each of the heater portions enables the jet to be deflected in any arbitrary azimuthal angle relative to the nozzle.

Figure 14:
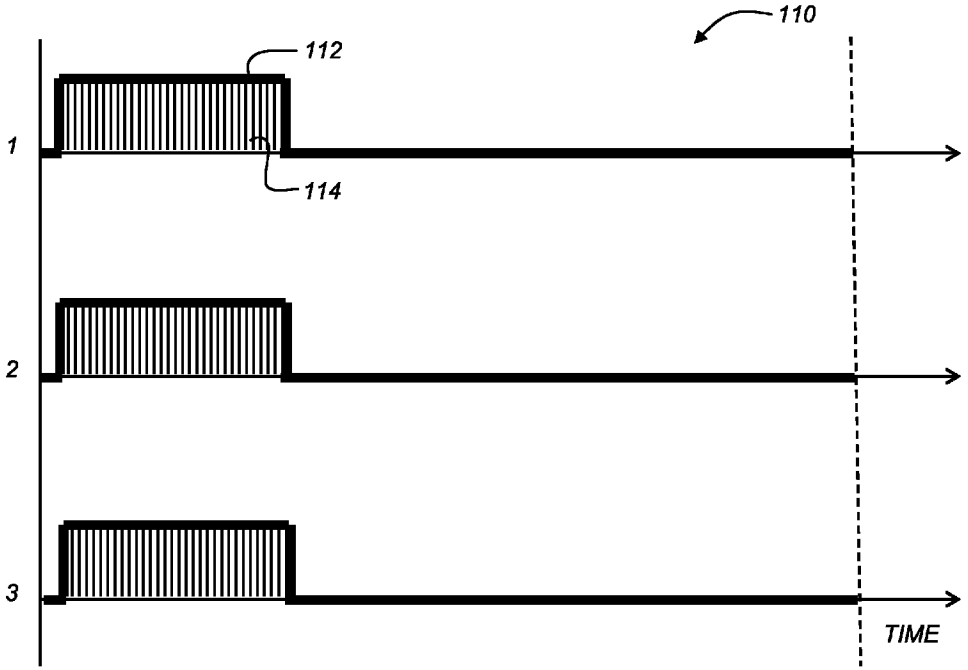
FIG. 14 is a schematic view of an example of electrical waveforms applied to the electrical contacts of the surrounding heater jet control element of FIG. 13.
Figure 15:
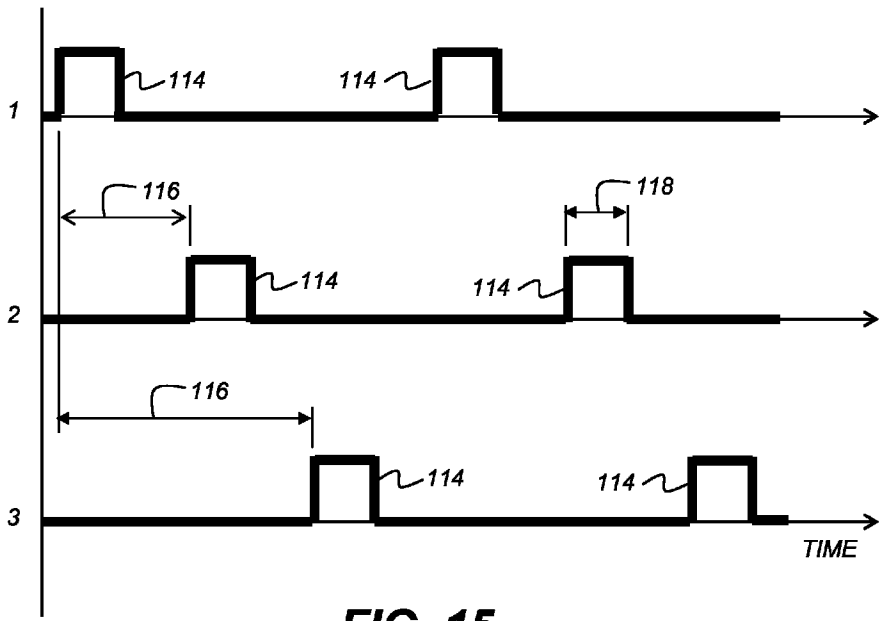
FIG. 15 is a schematic view of an example of portion of the electrical waveforms of FIG. 14.
Figure 16:
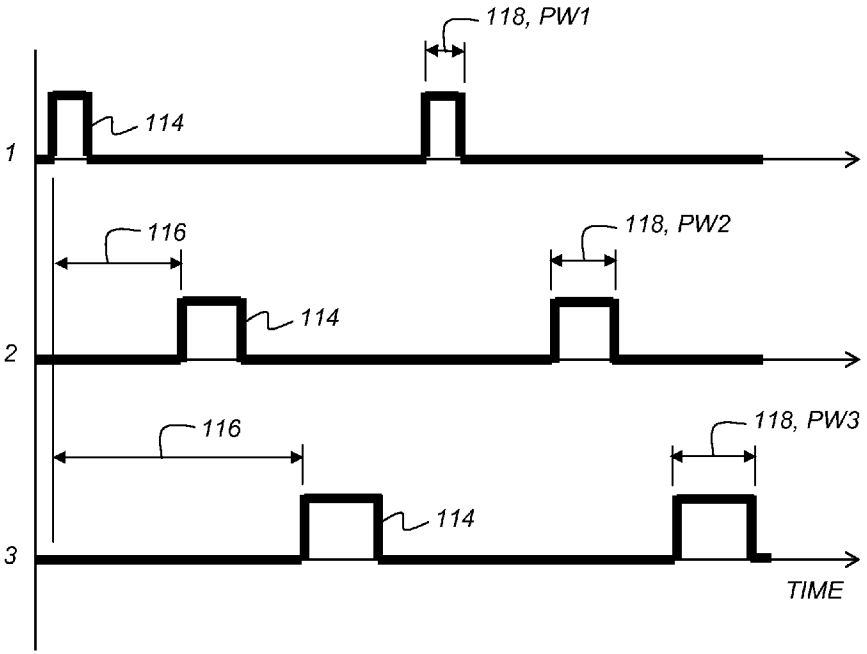
FIG. 16 is a schematic view of another example of portion of the electrical waveforms of FIG. 14.

FIGS. 14-16 illustrate one embodiment of a controlling waveform scheme for providing jet directionality control using the three actuatable heater portions. FIG. 14 shows the waveforms applied to the electrical contacts labels 1, 2, and 3. The waveforms include a drop formation pulse 112. The drop formation pulses applied to each of the electrical contacts 1, 2, and 3 are formed of a sequence of sub-pulses 114; the sub-pulses being provided at a carrier frequency that is much higher than the drop formation frequency. Typically the carrier frequency exceeds the thermal response rate of the heater, so that the heater temperature responds to the average power applied to the heater over several cycles of the carrier frequency. FIG. 15 shows an example expanded view of a portion of the drop formation pulse that includes the sub-pulse of two cycles of the carrier frequency. There is a phase shift 116 between the sub-pulses applied to each of the electrical contacts, so that there is a voltage pulse is applied to only one of the electrical contacts at a time. When a sub-pulse is applied to electrical contact 1, electrical contacts 2 and 3 are both as the ground potential so that the voltage of the sub-pulse 114 is applied across heater element portions A and C. In a similar manner, when a sub-pulse is applied to electrical contact 2, electrical contacts 1 and 3 are both as the ground potential so that the voltage of the sub-pulse 114 is applied across heater element portions A and B, and when a sub-pulse is applied to electrical contact 3, electrical contacts 1 and 2 are both as the ground potential so that the voltage of the sub-pulse 114 is applied across heater element portions B and C. In this example, the sub-pulses to each of the electrical contacts have the same pulse width 118. Assuming the heater element portions have matching electrical resistances, heat is applied uniformly to each of the heater element portions 104 around the nozzle 50. Such a symmetric application of heat around the nozzle would provide no steering of the jet flowing from the nozzle.

FIG. 16 shows another example of a portion of the sub-pulses applied to the electrical contacts 1, 2, and 3. In this example, the pulse width 118 of the sub-pulses differs for the individual electrical contacts. The pulse width of the sub-pulses applied to electrical contact 3 (denoted as PW3) is greater than the pulse width of the sub-pulses applied to electrical contacts 1 and 2. The pulse width of the sub-pulses applied to electrical contact 2 (denoted as PW2) is greater than the pulse width applied to electrical contact 1 (denoted as PW1); PW3>PW2>PW1. As all the sub-pulses have the same amplitude, the power applied to each heater element portion 104 is proportional to the width of the sub-pulses applied across the heater element portion. For each cycle of the carrier frequency, the power applied to portion A is proportional to PW1+PW2; the power applied to portion B is proportional to PW2+PW3, and the power applied to portion C is proportional to PW1+PW3. As a result in the pulse width differences, more is applied by heater portion B than heater portion C, which applies more heat than heater portion A. The result is that the heat distribution around the nozzle will cause the jet to be deflected at an angle between that of arrow b' and c', but closer to b' than c'.

Figure 17:
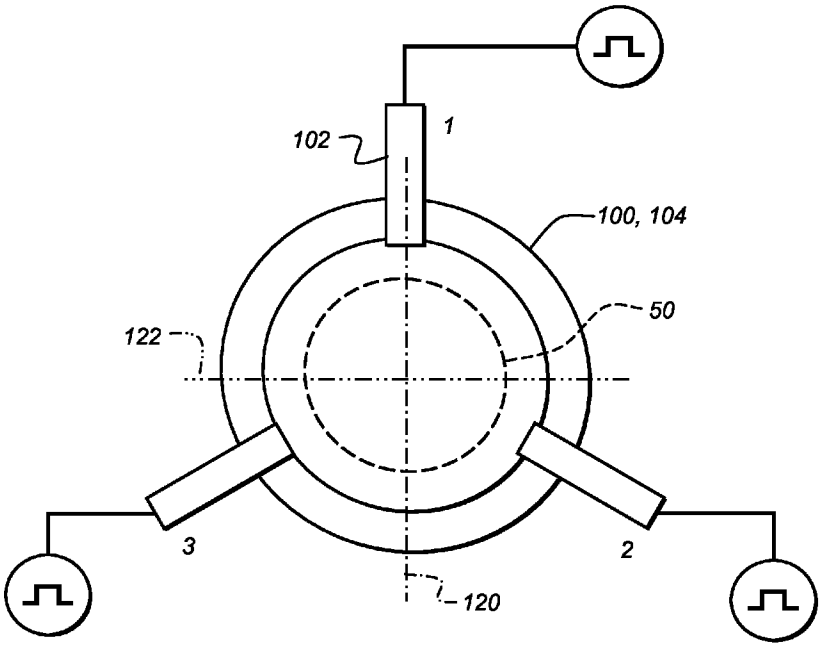
FIG. 17 is a schematic view of another example of a surrounding heater jet control element including an alternative electrical contact configuration.

In the continuous heater element embodiment of FIG. 13, the electrical contacts 102 were spaced apart from each other at equal angles around the axis of the nozzle; they are symmetrically placed around the continuous heater element. This configuration enables the jet to be steered to arbitrary azimuthal angles relative to the nozzle. The invention however is not limited to this configuration however. FIG. 17 shows an alternate electrical contact configuration. In this embodiment, electrical contact 1, lies on centerline 120 that divides the continuous heater element into a first side and a second side. To steer the jet to one side of the other of the centerline, requires a minimum of three electrical contacts; the contact that lies on the centerline and at least one remaining plurality of three or more electrical contacts is makes electrical contact with the continuous heater element on the first side of the centerline and another of the remaining plurality of three or more electrical contacts makes electrical contact with the continuous heater element on the second side of the centerline. Line 122 is a line that bisects the centerline 120 of the continuous heater element and is oriented perpendicularly to the centerline 120. To enable control whether the jet is deflected to one side or the other of the bisecting line requires at least one of the remaining plurality of three or more electrical contacts to make electrical contact with the continuous heater element on the opposite side of the bisecting line when compared to the location of the one of the plurality of three or more electrical contacts that makes electrical contact with the continuous heater element on the centerline.

Generally, as noted, in the example embodiments of the present invention, the jet control element 28 must rapidly form drops of arbitrarily selected sizes at rates typically corresponding to frequencies of 0.1 to 2 MHz, approximately the pixel rate in the direction of the paper path. Advantageously in this embodiment, the angle and magnitude of finely tailored drop steering does not have to change at these rates but can change at much slower rates. In particular, the angle and magnitude of finely tailored drop steering can remain the same for substantial times, typically 0.1 to 10,000 seconds. In other words, finely tailored drop steering modifies the landing spots of drops in a consistent way for long periods of time until a new direction or magnitude of finely tailored drop steering is needed. Because the finely tailored drop steering involves a large amount of data to discern between many landing positions of drops, for example between 100-1000 positions at a particular angle, and because the information on direction and magnitude of finely tailored drop steering is only occasionally updated, it is advantageous to store, for each nozzle, the data required for any particular instance of finely tailored drop steering. This is preferably accomplished by storing the data in a memory elements associated with each nozzle, preferably made on nozzle plate 49 along with the jet control elements 28. The type of memory element is not material to the current invention but includes commonly known dynamic and static shift registers which can be read out many times and which can be periodically updated, typically after thousands of readings. The current invention contemplates, at each nozzle, memory elements, preferably made during manufacture of the printhead; which can receive and store data, and which enables the data stored to be read multiple times without the data being altered. Such memory elements are well known in the art of semiconductor technology as is the ability to provide such memory elements, for example in the form of static or dynamic shift registers, during manufacture of nozzles and jet control elements 28 based on silicon technology. It is to be appreciated that many types of silicon based implementations of memory elements advantageously serve the purpose of the current invention. Finely tailored drop steering memory elements are preferably associated in a one to one correspondence with jet control elements 28 in accordance with the present invention, although it is within the spirit of the invention that a group of two or more nozzles might share a finely tailored drop steering memory element. The data stored in each of the memory elements 208, 210, 212 associated with nozzles include the data necessary to cause drops to be steered in a particular direction in accordance with finely tailored drop steering. Such memory elements must allow for the possibility of a very large number of very small variations in drop steering, or, equivalently drop placement on the receiver; specifically the current invention contemplates at least 100 to 10000 possible positions within a 20 micron range of printed drops on the receiver. Hence, data space needed for the finely tailored drop steering memory elements (reconfiguration data) is at least 10 to 14 bits. If the direction of steering is also desired to be controlled to a high precision, than a similar number of bits is required for the information of the direction of steering as well in each reconfiguration data memory element. Advantageously, this data need be updated only occasionally, for example every few seconds, at intervals much larger than the pixel time, which is typically 1 to 10 microseconds. It is also within the scope of the present invention that more than one set of reconfiguration data describing the angle and amount of finely tailored drop steering be stored in the reconfiguration data memory elements, along with the time of use for each set of data. For example, two sets of reconfiguration data might be stored, one to be used for 100,000 print drops and the other to be used for 50,000 print drops. This reduces the need to reprogram the reconfiguration data memory elements, although the memory elements must be correspondingly larger.

The data entered into the memory elements are responsive to printer system needs and may come from a variety of sources, including the original image data file. The data may also come from external physical sensors that monitor printer performance, such as sensors that monitor the precise placement of drops, either on the receiver or on the catcher. Such external sensors include, but are not limited to, sensors which determine drop landing positions through optical imaging of either non-printing drops landing on the catcher or printing drops landing on the receiver. In the latter case, microcontroller 38 can calculate the landing position of each drop relative to the corresponding pixel receiver grid, since the position of the receiver is also monitored by microcontroller 38. The purpose of such sensing is to determine whether or not the landing positions are optimal, and, if not, to feed back this information as corrected memory element data to be programmed into the associated finely tailored drop steering memory elements. For example, in the case the drops are caught, the location of landing on the catcher is important to the reliability of catching. Specifically, if the drops caught land on a particular catcher too close to the receiver, for example if they are closer than a drop diameter from the average of the landing positions of all drops landing on the catcher, the fluid on the catcher will be inordinately thick between the drops. In this case, the sensor or sensors observing the landing location would feed back information to the associated memory element(s) to cause the drops to be directed to landing positions more nearly in accord with the native nozzle-nozzle spacing. In accordance with the example embodiment, this feedback would occur on a time scale very long compared to the drop-drop forming time, for example, on a time scale of seconds, to allow the fluid on the catcher to come into and equilibrium position averaged over a long time, for example over several pages of image content. In this case, the adjustment in landing position would be very small amount, for example a fraction of a micron.

As another example, in the case the drops are printed, the location of landing on the receiver relative to the hypothetical receiver pixel grid is important to the printed image quality. Specifically, if the drops printed lie too close to one another, for example they are closer than 0.1 of the receiver grid spacing in the direction perpendicular to the receiver path, the image on the receiver will appear to suffer a line defect. In this case, the sensor or sensors observing the landing locations would feed back information to the associated finely tailored drop steering memory elements (s) to cause subsequent drops to be directed to landing positions more nearly in accord with the desired receiver pixel grid. In accordance with the example embodiment, this feedback would occur on a time scale very long compared to the drop-drop forming time, for example, on a time scale of seconds, to allow the printing process to be consistent over at least one printed page of image content. In this case, the amount of adjustment in printed position of the drops by the finely tailored drop deflection mechanism would be small, for example about a half micron, meaning that the angular precision of the feedback would needs be at least (0.5/5000)*60=6 milliradian, assuming the receiver pixel grid repeats in the slow scan direction in 30 micron increments. Thus the requirements of angular precision for the finely tailored drop deflection are advantageously comparable in both the direction perpendicular and parallel to the receiver path.

In both these cases, the maximum amount of finely tailored drop deflection would be less than the receiver pixel spacing in the direction perpendicular to the direction of the paper path, else the drops would be highly overlapped and the print quality compromised. An estimate of the dynamic range required of the finely tailored drop deflection memory element is found to be about 100-10000, which means the finely tailored drop steering memory elements must have a comparably large data storage capacity, as can be appreciated by one skilled in the art of digital data storage. This requirement is easily achieved by today's silicon technology, advantageously without occupying substantial space on the printhead. It is contemplated that finely tailored drop steering memory elements must include, for each specified direction and amount of finely tailored drop deflection, circuitry for conversion to practical electrical pulse trains to be applied to the surrounding jet control elements 28 so that the actual space required for the memory element will be larger than if only digital data for steering angel and magnitude need be stored. Still, this memory is not large by today's standards for IC fabrication.

The invention has been described in detail with particular reference to certain preferred example embodiments thereof, but it will be understood that variations and modifications can be effected within the scope of the invention.

PARTS LIST

20 Continuous Printer System
22 Image Source
24 Image Processing Unit
24*a* Image Memory
26 Mechanism Control Circuits
28 Jet Control Element
29 Jet Control Circuit
30 Printhead
32 Recording Medium (Receiver)
34 Recording Medium Transport System
36 Recording Medium Transport Control System
38 Micro-Controller
40 Reservoir
42 Catcher
44 Recycling Unit
46 Pressure Regulator
47 Channel
48 Jetting Module
49 Nozzle Plate
50 Nozzle
51*a* Jet Control Element
51*b* Continuously Surrounding Heater Jet Control Element
52 Liquid (Jet or Stream)
54 Drops
55 Printed Dots
56 Drops
57 Trajectory
58 Drop Stream
58 Steered Trajectory

60 Gas Flow Deflection Mechanism
61 Positive Pressure Gas Flow Structure
62 Gas Flow
63 Negative Pressure Gas Flow Structure
64 Deflection Zone
66 Small Drop Trajectory
68 Large Drop Trajectory
72 First Gas Flow Duct
74 Lower Wall
76 Upper Wall
78 Second Gas Flow Duct
82 Upper Wall
86 Liquid Return Duct
88 Plate
90 Front Face
92 Positive Pressure Source
94 Negative Pressure Source
96 Wall
100 Electrical Resistive Material
102 Electrical Contact
104 Heater Element Portions
110 Waveforms
112 Pulse
114 Sub-pulses
116 Phase Shift
118 Pulse Width
120 Centerline
122 Bisecting Line
200 Internal Bidirectional Data Interconnect
202 External Bidirectional Data Interconnect
208 Deactivation Memory Element
210 (Finely Tailored Drop Steering) Reconfiguration Data Memory Element
212 Compressed Reconfiguration Data Memory Element
220 (Print) Sensor
222 (Catch) Sensor
224 Print Manager Interface
230 (Reconfiguration) Trigger Signal

The invention claimed is:

1. A continuous printing system comprising:
a printhead including:
a nozzle; and
a jet control element including:
a continuous heater element positioned to surround the nozzle;
a plurality of three or more electrical contacts in electrical communication with the continuous heater element, the plurality of three or more electrical contacts defining a plurality of three or more continuous heater element portions that are actuatable with sufficient independence so as to control jet steering, the number of the continuous heater element portions equaling the number of electrical contacts; and
a controller configured to apply a first waveform to at least one of the plurality of three or more electrical contacts to affect at least one of the plurality of independently actuatable continuous heater element portions and a second waveform to at least one of the remaining plurality of three or more electrical contacts, wherein one of the first or second waveforms is applied in response to jet steering data and the other of the first or second waveforms is applied in response to print content data.

2. The system of claim 1, wherein the waveform is applied to the at least one of the plurality of three or more electrical contacts at a location point removed from a junction where the at least one of the plurality of three or more electrical contacts and the associated continuous heater element portion contact each other.

3. The system of claim 2, wherein the waveform is applied to the at least one of the plurality of three or more electrical contacts while at least one of the remaining plurality of three or more electrical contacts floats in response to the application of the waveform.

4. The system of claim 1, the continuous heater element including a centerline that divides the continuous heater element into a first side and a second side, wherein one of the plurality of three or more electrical contacts makes electrical contact with the continuous heater element on the centerline, the centerline passing through the location of electrical contact, and at least one of the remaining plurality of three or more electrical contacts is makes electrical contact with the continuous heater element on the first side of the centerline and another of the remaining plurality of three or more electrical contacts makes electrical contact with the continuous heater element on the second side of the centerline to permit selective steering of a liquid jet emitted from the nozzle toward the first side of the continuous heater element or the second side of the continuous heater element.

5. The system of claim 4, the continuous heater element including a bisecting line that perpendicularly bisects the centerline of the continuous heater element, wherein at least one of the remaining plurality of three or more electrical contacts makes electrical contact with the continuous heater element on the opposite side of the bisecting line when compared to the location of the one of the plurality of three or more electrical contacts makes electrical contact with the continuous heater element on the centerline.

6. The system of claim 1, wherein the plurality of three or more electrical contacts makes contact with the continuous heater element symmetrically around the continuous heater element.

* * * * *